US006645710B2

(12) United States Patent
Nishimura et al.

(10) Patent No.: US 6,645,710 B2
(45) Date of Patent: Nov. 11, 2003

(54) SILVER HALIDE COLOR PHOTOGRAPHIC LIGHT-SENSITIVE MATERIAL

(76) Inventors: Ryoji Nishimura, c/o Fuji Photo Film Co., Ltd., No. 210 Nakanuma, Minami-Ashigara-shi, Kanagawa (JP); Yasushi Nozawa, c/o Fuji Photo Film Co., Ltd., No. 210 Nakanuma, Minami-Ashigara-shi, Kanagawa (JP)

( * ) Notice: Subject to any disclaimer, the term of this patent is extended or adjusted under 35 U.S.C. 154(b) by 0 days.

(21) Appl. No.: 09/935,691

(22) Filed: Aug. 24, 2001

(65) Prior Publication Data

US 2002/0055073 A1 May 9, 2002

(30) Foreign Application Priority Data

Aug. 25, 2000 (JP) ..... 2000-256166

(51) Int. Cl.[7] ..... G03C 1/46
(52) U.S. Cl. ..... 430/505; 430/506; 430/567
(58) Field of Search ..... 430/506, 505, 430/567

(56) References Cited

U.S. PATENT DOCUMENTS

| | | | | |
|---|---|---|---|---|
| 4,766,058 A | | 8/1988 | Sampei et al. | |
| 5,091,293 A | | 2/1992 | Nozawa et al. | |
| 5,322,766 A | | 6/1994 | Sowinski et al. | |
| 5,476,758 A | * | 12/1995 | Suga et al. | 430/503 |
| 5,945,264 A | * | 8/1999 | Asami et al. | 430/203 |

* cited by examiner

*Primary Examiner*—Geraldine Letscher

(57) ABSTRACT

A silver halide color photographic light-sensitive material comprising, on a support, a unit blue-sensitive silver halide emulsion layer, unit green-sensitive silver halide emulsion layer, and unit red-sensitive silver halide emulsion layer, each of which includes not less than two color-sensitive layers differing in sensitivity, wherein tabular grains having an aspect ratio of not less than 5.0 account for not less than 60% of the total projected area of silver halide grains contained in an emulsion layer having the highest sensitivity in each unit color-sensitive layer, and a grain number indicated by specific equation is not more than 1.00.

17 Claims, No Drawings

SILVER HALIDE COLOR PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 2000-256166, filed Aug. 25, 2000, the entire contents of which are incorporated herein by reference.

BACKGROUND OF THE INVENTION

1. Field of the Invention

The present invention relates to a silver halide color photographic light-sensitive material and, more particularly, to a silver halide color photographic light-sensitive material which has high image quality regardless of its high sensitivity, i.e., which has high graininess and high sharpness, and which is also excellent in storage stability.

2. Description of the Related Art

Recently, a film with lens "UTSURUNDESU800" having both high sensitivity and high image quality is put on the market, so the habitual use of silver halide color photographic light-sensitive materials in a high-sensitive region is reliably spreading.

Thus increasing the sensitivity of a film can extend the regions of photography by light-sensitive materials. Examples are photographing using no electronic flash in a dark room, photographing at high shutter speeds using telephoto lenses such as sports photography, and photographing requiring long exposure time such as astronomical photography. This brings about great merits to users. Accordingly, increasing the sensitivity of a film is one eternal subject matter imposed on this industry.

Since increasing the sensitivity was pursued too much on conventional high-speed films, only low-quality films far exceeding the limit of user's patience could be provided. This forced users to choose between the two, i.e., the sensitivity and the image quality. Consequently, users had to choose the image quality rather than the sensitivity.

To increase the sensitivity of a light-sensitive material, the conventional approach in this industry is to increase the size of a silver halide grain as a light-sensitive element and use another sensitivity increasing technology at the same time.

When the grain size of a silver halide is increased, the sensitivity rises to some extent. However, as long as the content of the silver halide is constant, the number of silver halide grains, i.e., the number of development start points inevitably reduces. This largely deteriorates the graininess.

If a light-sensitive material is so designed as to increase the number of silver halide grains per unit area in order to compensate for this drawback as much as possible, the film thickness of a photosensitive layer increases accordingly. Also, the sharpness of the film cannot be well increased owing to, e.g., scattering of incident light induced by the silver halide grains. This makes it very difficult to achieve high graininess and high sharpness at the same time.

In addition, if a light-sensitive material is so designed as to increase the number of silver halide grains per unit area as described above, i.e., if the amount of silver halide coated in the material is increased, as described in Jpn. Pat. Appln. KOKAI Publication No. (hereinafter referred to as JP-A-) 63-226650, the photographic properties deteriorate, e.g., the fog increases, the sensitivity lowers, and the graininess deteriorates, before the light-sensitive material is used after the manufacture.

To solve these problems, improving techniques by which high sensitivity and high image quality coexist have been investigated in this industry.

For example, as an approach to the design of a color light-sensitive material, JP-A-62-17747 discloses a technique which improves the sharpness and the graininess by defining the silver density and dried film thickness of a blue-sensitive silver halide emulsion layer. U.S. Pat. No. 5,322,766 discloses a technique which improves the image quality with a small silver amount by defining the silver amount and film thickness of an image forming unit and the flatness and silver/coupler ratio of silver halide grains.

Also, JP-A-63-226650 described above discloses a technique which improves the image quality, storage stability, and resistance to pressure by defining the total silver content and the silver amount of a highest-sensitivity layer of a color negative light-sensitive material having a specific photographic sensitivity of 800 to 6,400.

Unfortunately, improvements by these techniques were not well satisfactory. That is, the ultimate image quality levels of graininess and sharpness were unsatisfactory in a region where the specific photographic sensitivity was 800 or more. Also, the effects of improving deterioration of the image quality after storage were insufficient.

On the other hand, when the image quality level or that after storage was satisfied at all times, the specific photographic sensitivity became insufficient. Accordingly, no satisfactory prints could be obtained by photographing in a room in which the use of an electronic flash was prohibited.

As described previously, increasing the sensitivity of a film can extend the regions of photography by light-sensitive materials. Hence, the development of a silver halide color photographic light-sensitive material having high sensitivity and high image quality at the same time is particularly being desired lately.

BRIEF SUMMARY OF THE INVENTION

It is an object of the present invention to provide a silver halide color photographic light-sensitive material having high graininess and high sharpness regardless of its high sensitivity, and to provide a silver halide color photographic light-sensitive material which is also excellent in storage stability.

The present inventors made extensive studies and could achieved the above object by the present invention having the following arrangements.

(1) A silver halide color photographic light-sensitive material comprising, on a support, a unit blue-sensitive silver halide emulsion layer, unit green-sensitive silver halide emulsion layer, and unit red-sensitive silver halide emulsion layer, each of which includes not less than two color-sensitive layers differing in sensitivity, wherein tabular grains having an aspect ratio of not less than 5.0 account for not less than 60% of the total projected area of silver halide grains contained in an emulsion layer having the highest sensitivity in each unit color-sensitive layer, and a grain number indicated by equation (I) below is not more than 1.00:

$$(\text{Grain number})=A_H/(D_c^2\times T_h) \quad \text{(I)}$$

where $A_H$: a silver coating amount (g/m$^2$), as an amount of silver, of a silver halide contained in an emulsion layer having the highest sensitivity $D_c$: an average equivalent-circle diameter ($\mu$m) of silver halide grains contained in an emulsion layer having the highest sensitivity $T_h$: an average thickness ($\mu$m) of silver halide grains contained in an emulsion layer having the highest sensitivity, if silver halide grains contained in the emulsion layer are a mixture of not less than two types of silver halide emulsion grains having different average equivalent-circle diameters, the grain number is calculated from $A_H$, $D_c$, and $T_h$ of emulsion grains, of the not less than two types of emulsion grains, having the largest average equivalent-circle diameter.

(2) The material according to item (1), wherein silver halide grains contained in an emulsion layer having the highest sensitivity in each unit color-sensitive layer are tabular grains which:

(a) have an average silver iodide content of 2 to 10 mol %, (b) have an average surface silver iodide content of 1 to 4 mol %, and (c) have not less than 10 dislocation lines per grain.

(3) The material according to item (1) or (2), wherein the total content of silver contained in the light-sensitive material is 3.0 to 8.5 g/m$^2$. (4) The material according to one of items (1) to (3), wherein the specific photographic sensitivity is not less than 1,000.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in more detail below.

A silver halide color photographic light-sensitive material of the present invention has, on a support, a unit blue-sensitive silver halide emulsion layer, unit green-sensitive silver halide emulsion layer, and a unit red-sensitive silver halide emulsion layer, each of which is composed of two or more color-sensitive layers differing in sensitivity.

In the present invention, it is preferable to form various non-photosensitive layers such as a protective layer, color amalgamation preventing layer, yellow filter layer (also serving as a color amalgamation preventing layer), and antihalation layer, in addition to photosensitive emulsion layers.

Although the order of the arrangement of these layers is not particularly limited, a typical example is a color photographic light-sensitive material in which a protective layer, unit blue-sensitive emulsion layer, yellow filter layer (also serving as a color amalgamation preventing layer), unit green-sensitive emulsion layer, color amalgamation preventing layer, unit red-sensitive emulsion layer, color amalgamation preventing layer, and antihalation layer are arranged in this order toward a support from the one farthest from the support.

Each unit color-sensitive layer consists of a plurality of emulsion layers sensitive to substantially the same color but different in sensitivity. The order of the arrangement of these layers is not particularly restricted, but emulsion layers having higher sensitivity are generally arranged farther from a support.

To increase the sensitivity, a layer having the highest sensitivity in each of blue-, green-, and red-sensitive emulsion layers sensitive to different colors can also be placed in a position farthest from a support, in addition to the above-mentioned typical arrangement. For example, a protective layer, highest-speed blue-sensitive emulsion layer, color amalgamation preventing layer, highest-speed green-sensitive emulsion layer, color amalgamation preventing layer, highest-speed red-sensitive emulsion layer, color amalgamation preventing layer, a plurality of blue-sensitive emulsion layers, yellow filter layer (also serving as a color amalgamation preventing layer), a plurality of green-sensitive emulsion layers, color amalgamation preventing layer, a plurality of red-sensitive emulsion layers, color amalgamation preventing layer, and antihalation layer are arranged in this order from the one farthest from a support.

To increase the sensitivity, it is also possible to properly arrange a light reflecting layer in order to efficiently use light incident on a light-sensitive material. Examples of a reflecting substance contained in this light reflecting layer are fine silver halide grains and an inorganic crystal represented by $TiO_2$. When fine silver halide grains are used, for example, the grain thickness is favorably set in accordance with the wavelength of desired light in order to selectively reflect the wavelength of incident light.

As described previously and described in, e.g., JP-A-58-147744, to improve, even slightly, the graininess of a high-speed color negative light-sensitive material, the content of silver halide emulsion grains is increased as much as possible in this industry. However, as described in JP-A-63-226650, from the viewpoint of deterioration of the image quality after a light-sensitive material is stored, the effect of improving the graininess is small even when the silver amount is increased more than a certain amount. On the contrary, deterioration of the image quality by storage after coating becomes significant. On the other hand, if the silver amount used in a light-sensitive material is set to be too small, it becomes impossible to maintain desired specific sensitivity or keep the maximum density.

Accordingly, the total content of silver contained in a color photographic light-sensitive material of the present invention is preferably 3.0 to 8.5 g/m$^2$, and more preferably, 5.0 to 8.0 g/m$^2$ as a coating amount.

The specific photographic sensitivity of a color photographic light-sensitive material of the present invention is not particularly limited. However, to achieve the effects of the present invention, this sensitivity is preferably 640 or more, more preferably, 800 or more, even more preferably, 1,000 or more, and most preferably, 1600 or more.

Details of the specific photographic sensitivity will be described below.

ISO sensitivity as an international standard is generally used as the sensitivity of a photographic light-sensitive material. This ISO sensitivity specifies that a light-sensitive material is to be developed five days after exposure, and that the process of development can be designated by each company. In the present invention, therefore, the time from exposure to development is shortened, and constant development is performed.

This specific photographic sensitivity determination method is based on JIS K 7614-1981 except that development is completed within 30 min to 6 hr after sensitometry exposure, and that this development is performed by FUJICOLOR process formulation CN-16 explained in Example 1 to be described later. The rest is substantially the same as the measurement method described in JIS.

In a silver halide light-sensitive material of the present invention, each of unit blue-, green-, and red-sensitive emulsion layers is composed of two or more emulsion layers different in sensitivity. 60% or more of the total projected area of silver halide grains contained in a highest-speed layer of each unit color-sensitive layer are accounted for by tabular silver halide grains having an aspect ratio of 5 or more (these silver halide grains will also be referred to as "tabular grains of the present invention" hereinafter). Tabular grains of the present invention preferably have a aspect ratio of 8 or more.

In a silver halide light-sensitive material of the present invention, the form of silver halide grains used in emulsion layers except for the highest-speed layers is not particularly restricted. That is, the grains can be regular crystal grains such as cubic, octahedral, or tetradecahedral grains, tabular grains having (111) major faces, tabular grains having (100) major faces, or epitaxial grains. However, the grains are favorably tabular grains. When this is the case, it is preferable that these tabular grains be silver iodobromide grains or silver bromochloroiodide grains and have dislocation lines.

In a color photographic light-sensitive material of the present invention, the grain number of a highest-speed emulsion layer in each of unit blue-, green-, and red-sensitive silver halide emulsion layers is 1.00 or less.

This "grain number" is represented by equation (I) below in the relationship between the average equivalent-circle diameter ($D_c$: $\mu$m) of tabular silver halide grains contained in a highest-speed emulsion layer of each unit color-sensitive layer consisting of a plurality of layers sensitive to the same color, the average thickness ($T_h$: $\mu$m) of the silver halide grains, and the silver coating amount ($A_H$: g/m$^2$), as an amount of silver, of the silver halide grains.

$$(\text{Grain number})=A_H/(D_c^2\times T_h) \quad \text{(I)}$$

($D_c^2\times T_h$) is the value correlating with the volume of a tabular silver halide grain. The value obtained by dividing the silver coating amount $A_H$ by this value is the grain number. That is, the grain number can be regarded as correlating with the number of grains contained in an emulsion layer.

Surprisingly, the present inventors have found that the grain number of tabular grains, 60% or more of the total projected area of which are accounted for by tabular silver halide grains having an aspect ratio of 5 or more, used in individual highest-speed layers sensitive to different colors, correlates with the realization of a silver halide color photographic light-sensitive material in which high sensitivity and high image quality coexist and which is also given resistance to storage.

As represented by JP-A-63-226650 and U.S. Pat. No. 5,322,766 described earlier, the sensitivity, image quality, and storage stability are improved by reducing the total silver amount in a light-sensitive material, the silver amount in layers sensitive to the same color, or the silver amount in a highest-speed layer as small as possible. This is the conventional approach in this industry. However, these techniques simply define the silver coating amount, i.e., the number of grains, such that the silver amount in a highest-speed layer is 0.3 to 1.4 g/m$^2$ and the silver amount in layers sensitive to the same color is 0.2 to 2.0 g/m$^2$. In addition, these numerical values are amounts within very common ranges as silver halide color photographic light-sensitive materials introduced into the market for general purposes in this industry.

Accordingly, it is surprising that when tabular grains are used in a highest-speed layer of each unit color-sensitive layer, a color light-sensitive material having high sensitivity, high image quality, and high storage stability at the same time can be obtained by determining the silver amount used in accordance with the grain size of the tabular grains contained in that layer, more specifically, in accordance with the equivalent-circle diameter and thickness of these tabular grains. This means that the object of the present invention is achieved by limiting the total number of highest-speed tabular grains to be used in a highest-speed layer to a certain amount or less, rather than by simply reducing the silver amount used.

Even when tabular grains of the present invention are used in the highest-speed layer, at least one of the sensitivity, image quality, and storage stability deteriorates if the grain number exceeds 1.00.

Also, at least one of the sensitivity, image quality, and storage stability deteriorates if the grain number exceeds 1.00 in even one of highest-speed emulsion layers of unit blue-, green-, and red-sensitive layers sensitive to different colors.

The grain number of each highest-speed layer in a color photographic light-sensitive material of the present invention is preferably 0.90 or less, and more preferably, 0.80 or less.

A plurality of types of silver halide grains prepared through different manufacturing steps and having different grain sizes can be mixed in highest-speed layers sensitive to different colors in a color photographic light-sensitive material of the present invention. In this case, of these mixed grains, 60% or more of the total projected area of grains having the largest average average equivalent-circle diameter must be accounted for by tabular grains having an aspect ratio of 5 or more, and the grain number calculated from the silver coating amount $A_H$, $D_c$, and $T_h$ Of these grains must be 1.00 or less. An equivalent-sphere diameter means the diameter of a sphere having the same volume as each individual grain.

The form of silver halide grains which can be contained in the highest-speed layer in addition to grains having the largest average equivalent-circle diameter is not particularly limited. For example, these silver halide grains can be regular crystal grains such as cubic, octahedral, or tetradecahedral grains, tabular grains having (111) major faces, tabular grains having (100) major faces, or epitaxial grains. However, the grains are favorably tabular grains.

60% or more of the total projected are of these tabular grains are preferably accounted for by tabular grains having an aspect ratio of 5 or more. The halogen composition is favorably silver iodobromide or silver bromochloroiodide. The tabular grains preferably have 10 or more dislocation lines per gain. The grain number calculated from the silver amount $A_H$, $D_c$, and $T_h$ of the tabular grains is preferably 1.00 or less.

Tabular silver halide grains used in the present invention will be described in more detail below.

A tabular grain has two parallel major faces and side faces connecting these major faces, as outer surfaces. A tabular grain is a grain having one twin plane or two or more parallel twin planes. If ions at all lattice points have a mirror image relationship to each other on the two sides of a (111) face, this (111) face is a twin plane. When this tabular grain is viewed in the direction perpendicular to its major face, the major face has a triangular shape, a hexagonal shape, or a circular shape which is a rounded triangular or hexagonal shape. A triangular, hexagonal, and circular major faces are triangular, hexagonal, and circular, respectively.

A side face can be a (111) face, a (100) face, or a mixture of these faces, and can further contain a higher-index face.

In the present invention, a tabular grain emulsion described in European Patent No. 515894A1, the disclosure of which is incorporated herein by reference, in which the ratio of (111) faces in side faces is low, is preferably used. At least one twin plane exists between the (111) major faces, and two twin planes are usually observed. As described in U.S. Pat. No. 5,219,720, the spacing between the two twin planes can be decreased to less than 0.012 μm. Also, as described in JP-A-5-249585, the value obtained by dividing the distance between the (111) major faces by the twin plane spacing can be increased to 15 or more.

The aspect ratio of a tabular grain means the ratio of the diameter to the thickness of a silver halide grain. That is, the aspect ratio is a value obtained by dividing the equivalent-circle diameter of each silver halide grain by its thickness. The equivalent-circle diameter herein mentioned is the diameter of a circle having an area equal to the projected area of a silver halide grain when the grain is observed with a microscope or an electron microscope. Therefore, when a grain has an aspect ratio of 5 or more, this means that this equivalent-circle diameter is five times the thickness of the grain or more.

An example of an aspect ratio measurement method is a method of taking a transmission electron micrograph by a replica method and obtaining the equivalent-circle diameters and thicknesses of individual grains. In this method, the thickness is calculated from the length of the shadow of the replica.

In tabular grains of the present invention, 60% or more of the total projected are accounted for by tabular grains having an aspect ratio of 5 or more, preferably, 7 or more, and more preferably, 10 or more. If the aspect ratio is too large, the variation coefficient of the grain size distribution often increases. Commonly, therefore, the aspect ratio is favorably 30 or less.

In tabular grains of the present invention, the ratio accounted for by tabular grains having an aspect ratio of 5 or more is 60% or more, and preferably, 80% or more of the total projected area. If the ratio accounted for by tabular grains having an aspect ratio of 5 or more is less than 60%, the photographic properties too deteriorate to achieve the object of the present invention.

Tabular grains used in the present invention are preferably monodisperse. Although the structure and the method of manufacturing monodisperse tabular grains are described in, e.g., JP-A-63-151618, the shape of the grains will be briefly described below. That is, 70% or more of the total projected area of silver halide grains are accounted for by tabular grains having a hexagonal shape, in which the ratio of an edge having the maximum length with respect to the length of an edge having the minimum length is 2 or less, and having two parallel surfaces as outer surfaces. In addition, the grains have monodispersibility; that is, the variation coefficient of the grain size distribution of these hexagonal tabular grains (i.e., the value obtained by dividing the variation (standard deviation) of grain sizes, which are represented by the equivalent-circle diameters of the projected areas of the grains, by their average grain size) is 20% or less. The variation coefficient of the grain size distribution is preferably 18% or less.

The average equivalent-circle diameter of tabular grains of the present invention is preferably 0.3 to 5.0 μm, and more preferably, 1.0 to 4.0 μm.

The average thickness ($T_h$) of tabular grains of the present invention is preferably less than about 0.8 μm, more preferably, 0.05 to 0.6 μm, and most preferably, 0.1 to 0.5 μm. In this case, the variation coefficient of the thickness distribution is favorably monodisperse, i.e., 20% or less.

Tabular silver halide grains of the present invention are made of silver iodobromide or silver bromochloroiodide. Although grains may or may not contain silver chloride, the silver chloride content is preferably 8 mol % or less, and more preferably, 3 mol % or less or 0 mol %. The silver iodide content is preferably 5 to 20 mol %, and particularly preferably, 7 to 15 mol %. The variation coefficient of the silver iodide content distribution between grains is preferably 20% or less, and particularly preferably, 10% or less.

The average silver iodide content of tabular grains of the present invention is favorably 2 to 10 mol %.

The average silver iodide content can be measured by analyzing the compositions of individual grains by using an X-ray microanalyzer. This average silver iodide content is an arithmetic mean obtained by measuring the silver iodide contents of at least 100 emulsion grains. A method of measuring the silver iodide content of each individual grain is described in, e.g., European Patent No. 147868A.

If the average silver iodide content of the tabular grains is less than 2 mol %, no improvement of the sensitivity/graininess ratio based on silver iodide can be expected. If the average silver iodide content exceeds 10 mol %, the chemical sensitization efficiency lowers, so no high sensitivity can be accomplished.

The average surface silver iodide content of tabular silver halide grains of the present invention is preferably 1 to 4 mol %. The "surface" means a region within 5 nm from the grain surface, i.e., a region detectable by XPS explained next.

The silver iodide content on the grain surface can be measured by XPS (X-ray Photoelectron Spectroscopy). The principle of XPS is described in detail in, e.g., Junich Aihara et al., "Spectra of Electrons" (Kyoritsu Library 16: issued 1978 by Kyoritsu Shuppan).

A standard measurement method of XPS is to use Mg-Kα as excitation X-rays and measure the intensities of photoelectrons of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase.

If the average surface silver iodide content of the tabular grain is less than 1 mol % or exceeds 4 mol %, the chemical sensitization efficiency lowers, no improvement of the sensitivity/graininess ratio can be expected, and no high sensitivity can be accomplished.

A method of preparing silver halide grains will be described below.

As a silver halide emulsion preparation method, a general method is to form silver halide nuclei and then grow silver halide grains to obtain grains having a desired size. This similarly applies to the present invention. The formation of tabular grains includes at least nucleation, ripening, and growth steps. These steps are described in detail in U.S. Pat. No. 4,945,037, the disclosure of which is incorporated herein by reference. In the growth step, an aqueous silver salt solution and a halogen salt solution are added to a reaction vessel by the double-jet method, thereby growing silver halide grain nuclei. In the growth by the double-jet method, a method of controlling the pAg of the reaction solution can also be used.

EP515894A1 can be referred to as a method of changing the face index of a side face of a tabular grain emulsion.

Also, polyalkyleneoxide compounds described in, e.g., U.S. Pat. No. 5,252,453 can be used. As an effective method, face index modifiers described in, e.g., U.S. Pat. No. 4,680,254, U.S. Pat. No. 4,680,255, U.S. Pat. No. 4,680,256, and U.S. Pat. No. 4,684,607 can be used. Common photographic spectral sensitizing dyes can also be used as face index modifiers analogous to those described above.

In the present invention, a silver iodobromide emulsion or silver bromochloroiodide tabular grain emulsion can be prepared by various methods as long as the aforementioned requirements are met. Usually, the preparation of a tabular grain emulsion basically includes three steps: nucleation, ripening, and growth. In the tabular grain emulsion nucleation step of the present invention, it is extremely effective to use gelatin with a small methionine content described in U.S. Pat. No. 4,713,320 and U.S. Pat. No. 4,942,120, perform nucleation with a high pBr as described in U.S. Pat. No. 4,914,014, and perform nucleation within a short time period as described in JP-A-2-222940. In the tabular grain emulsion ripening step of the present invention, it is sometimes effective to perform ripening in the presence of a low-concentration base as described in U.S. Pat. No. 5,254,453 or at a high pH as described in U.S. Pat. No. 5,013,641. In the tabular grain emulsion growth step of the present invention, it is particularly effective to perform growth at low temperature as described in U.S. Pat. No. 5,248,587, and use fine silver iodide grains described in U.S. Pat. No. 4,672,027 and U.S. Pat. No. 4,693,964. Furthermore, a silver bromide, silver iodobromide, or silver bromochloroiodide fine-grain emulsion can be preferably added and grown by ripening. The above fine-grain emulsion can also be supplied by using a stirrer described in JP-A-10-043570.

Tabular silver halide grains of the present invention favorably have dislocation lines.

Dislocation lines in tabular grains can be observed by a direct method using a transmission electron microscope at a low temperature described in, for example, J. F. Hamilton, Phot. Sci. Eng., 11, 57, (1967) or T. Shiozawa, J. Soc. Phot. Sci. Japan, 35, 213, (1972).

That is, silver halide grains, extracted carefully from an emulsion so as not to apply a pressure by which dislocations are produced in the grains, are placed on a mesh for electron microscopic observation. Observation is performed by a transmission method while the sample is cooled to prevent damage (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). Note that dislocation lines can or cannot be seen depending on the angle of inclination of a sample with respect to electron rays. Therefore, in order to observe dislocation lines, it is necessary to obtain the positions of dislocation lines by observing photographs of the same grain taken at as many sample inclination angles as possible. From photographs of grains obtained by the above method, it is possible to obtain the positions and the number of dislocation lines in each grain viewed in the direction perpendicular to the major faces of the grain.

In a silver halide grain of the present invention, dislocation lines preferably exist in a portion of 20% or less, and favorably, 10% or less as an area from the edge of a projecting portion of that grain. Dislocation lines can be present near and along the edge and can also be localized in the vicinity of a corner. The vicinity of a corner is, when perpendiculars are drawn to edges forming each apex from an x% position from the center of a straight line connecting the center of a grain and the apex, a three-dimensional portion surrounded by these perpendiculars and edges. The value of this x is preferably 50 to less than 100, and more preferably, 75 to less than 100. The number of existing dislocation lines is favorably 10 or more, and more favorably, 20 or more per grain on the average.

To introduce dislocation lines, it is possible to use: a method described in JP-A-63-220238 in which aqueous solutions of $Ag^+$ ions and $I^-$ ions are added by the double-jet method to form a silver halide layer containing silver iodide; a method described in JP-A-11-15088 in which shells are formed after fine AgI grains are abruptly added; a method described in U.S. Pat. No. 5,496,694 in which a silver halide layer containing silver iodide is formed while iodide ions are abruptly added by using an iodide ion releasing agent; and a method described in JP-A-4-14951 or JP-A-9-189974 in which dislocation lines are selectively introduced to a specific portion of a silver halide grain.

Also, a silver halide grain of the present invention can have, in addition to a silver halide grain body, a silver halide crystal portion (i.e., an epitaxial portion) junctioned to the grain. The ratio of the silver amount of this junctioned silver halide crystal portion (epitaxial portion) to the total silver amount of a grain containing this epitaxial portion is favorably 2% to 30%, and more favorably, 5% to 15%. Although the epitaxial portion can exist in any portion, this epitaxial portion preferably exists in a grain major surface portion, grain edge portion, or grain corner portion. The halogen composition of the epitaxial portion is preferably AgCl, AgBrCl, AgBrClI, AgBrI, AgI, or AgSCN, and more preferably, AgCl, AgBrCl, or AgBrClI.

In this epitaxial portion, a substance which temporarily captures electrons is desirably present.

Practical examples are salts of metal ions to be described later such as $K_3[Fe(CN)_6]$, $(NH_4)_4[Fe(CN)_6]$, $K_3IrCl_6$, and $K_4[Ru(CN)_6]$.

Tabular grains of the present invention are preferably subjected to reduction sensitization.

Reduction sensitization can be selected from a method of adding reduction sensitizers to a silver halide emulsion, a method called silver ripening in which grains are grown in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers during the growth of silver halide grains is preferred in that the level of reduction sensitization can be finely adjusted. Known examples of reduction sensitizers are stannous chloride, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers and to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion manufacturing conditions, a preferred amount is $10^{-7}$ to $10^{-2}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

An oxidizer for silver is favorably used in the formation of tabular silver halide grains of the present invention.

An oxidizer for silver is a compound having an effect of converting metal silver into silver ion. A compound which converts very fine silver grains, formed as a by-product in the processes of formation and chemical sensitization of silver halide grains, into silver ion is particularly effective. The silver ion produced can form a silver salt sparingly soluble in water, such as a silver halide, silver sulfide, or silver selenide, or a silver salt readily soluble in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2\{Ti(O_2)C_2O_4\}.3H_2O$, $4K_2SO_4.Ti(O_2)OH.SO_4.2H_2O$, and $Na_3\{VO(O_2)(C_2H_4)_2.6H_2O\}$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferred oxidizers for use in tabular grains of the present invention are inorganic oxidizers such as ozone, hydrogen peroxide and its adduct, a halogen element, and thiosulfonate, and organic oxidizers such as quinones. It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be selectively used in the grain formation step or the chemical sensitization step.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates, and sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash a silver halide emulsion of the present invention to form a newly prepared protective colloid dispersion for a desalting purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. Coagulation precipitation can be selected from a method using sulfate, a method using an organic solvent, a method using a water-soluble polymer, and a method using a gelatin derivative.

In the preparation of silver halide emulsion grains of the present invention, it is preferable to make salt of metal ion exist during grain formation, desalting, or chemical sensitization, or before coating, in accordance with the intended use. The metal ion salt is preferably added during grain formation when doped into grains, and after grain formation and before the completion of chemical sensitization when used to decorate the grain surface or when used as a chemical sensitizer. This metal ion salt can be doped into an overall grain or only into a core, shell, or epitaxial portion of a grain, and can also be doped only into a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used singly, but two or more types of them can also be combined.

The metal compounds are preferably dissolved in an appropriate solvent, such as methanol or acetone, and added in the form of a solution. To stabilize the solution, an aqueous halogenated hydrogen solution (e.g., HCl or HBr) or an alkali halide (e.g., KCl, NaCl, Kbr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during the formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during the preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains used in the present invention, at least one of chalcogenide sensitization such as sulfur sensitization, selenium sensitization, and tellurium sensitization; noble metal sensitization such as gold sensitization and palladium sensitization; and reduction sensitization can be performed at any point during the process of manufacturing a silver halide emulsion. The use of two or more different sensitizing methods is favored. Several different types of emulsions can be prepared by changing the timing at which this chemical sensitization is performed. The emulsion types are classified into: a type in which a chemical sensitization speck is embedded inside a grain; a type in which it is embedded in a shallow position from the surface of a grain; and a type in which it is formed on the surface of a grain. In an emulsion of the present invention, the position of a chemical sensitization speck can be selected in accordance with the intended use. However, it is generally preferable to form at least one type of a chemical sensitization speck near the surface.

One chemical sensitization which can be preferably performed for silver halide emulsion grains used in the present invention is chalcogenide sensitization, noble metal sensitization, or the combination of the two. Sensitization can be performed by using an active gelation as described in T. H. James, The Theory of the Photographic Process, 4th ed., Macmillan, 1977, pages 67 to 76. Sensitization can also be performed by using any of sulfur, selenium, tellurium, gold, platinum, palladium, and iridium, or by using the combination of a plurality of these sensitizers at a pAg 5 to 10, a pH of 5 to 8, and a temperature of 30 to 80° C., as described in Research Disclosure (RD), Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferred palladium compound is represented by $R_2PdX_6$ or $R_2PdX_4$ wherein R represents a hydrogen atom, alkali metal atom, or ammonium group and X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is favorable that a gold compound and a palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for silver halide emulsions used in the present invention.

The amount of gold sensitizer is preferably $1\times10^{-4}$ to $1\times10^{-7}$ mol, and more preferably, $1\times10^{-5}$ to $5\times10^{-7}$ mol.

A preferred amount of palladium compound is $1\times10^{-3}$ to $5\times10^{-7}$ mol. A preferred amount of thiocyan compound or selenocyan compound is $5\times10^{-2}$ to $1\times10^{-6}$ mol.

The amount of sulfur sensitizer used for silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization and tellurium sensitization are other favored sensitizing methods for silver halide emulsions used in the present invention. Known labile selenium compounds are used in selenium sensitization. Practical examples of selenium compounds are colloidal metal selenium, selenoureas (e.g., N,N-dimethylselenourea and N,N-diethylselenourea), selenoketones, and selenoamides. It is sometimes favorable to perform selenium sensitization in combination with one or both of sulfur sensitization and noble metal sensitization.

Photographic emulsions used in the present invention can contain various compounds in order to prevent fog during the manufacturing process, storage, or photographic processing of a light-sensitive material, or to stabilize photographic properties. Usable compounds are those known as an antifoggant or a stabilizer, for example, thiazoles, e.g., benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during the preparation of an emulsion to achieve their original fog preventing effect and stabilizing effect. In addition, the antifoggants and the stabilizers can be used for various purposes of, e.g., controlling the crystal habit of grains, decreasing the grain size, decreasing the solubility of grains, controlling chemical sensitization, and controlling the arrangement of dyes.

Photographic emulsions used in the present invention are preferably subjected to spectral sensitization by methine dyes and the like in order to achieve the effects of the present invention. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618, and JP-A-52-109925.

Emulsions can contain, in addition to the sensitizing dyes, dyes having no spectral sensitizing effect or substances not essentially absorbing visible light and presenting supersensitization.

tization. Alternatively, as disclosed in U.S. Pat. No. 4,225,666, these compounds can be added separately; a portion of the compounds is added prior to chemical sensitization, while the remaining portion is added after that. That is, the compounds can be added at any timing during the formation of silver halide grains, including the method disclosed in U.S. Pat. No. 4,183,756.

Although the various additives described above can be used in a light-sensitive material according to the present invention, a variety of other additives can also be used in accordance with the intended use.

The details of these additives are described in RD Item 17643 (December, 1978), Item 18716 (November, 1979), and Item 308119 (December, 1989), and these portions are summarized in a table below.

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column to page 649, right column | page 996, right column to page 998, right column |
| 4. Brighteners | page 24 | page 647, right column | page 998, right column |
| 5. Antifoggants and stabilizers | pages 24–25 | page 649, right column | page 998, right column to page 1,000, right column |
| 6. Light absorbents, filter dyes, ultraviolet absorbents | pages 25–26 | page 649, right column to page 650, left column | page 1,003, left to right columns |
| 7. Stain preventing agents | page 25, right column | page 650, left to right columns | page 1,002, right column |
| 8. Dye image stabilizers | page 25 | page 1,002, right column | |
| 9. Hardening agents | page 26 | page 651, left column | page 1,004, right column to page 1,005, left column |
| 10. Binders | page 26 | page 651, left column | page 1,003, right column to page 1,004, right column |
| 11. Plasticizers, lubricants | page 27 | page 650, right column | page 1,006, left to right columns |
| 12. Coating aids, surface active agents | pages 26–27 | page 650, right column | page 1,005, left column to page 1,006, left column |
| 13. Antistatic agents | page 27 | page 650, right column | page 1,006, right column to page 1,007, left column |
| 14. Matting agents | | | page 1,008, left column to page 1,009, left column |

The sensitizing dyes can be added to an emulsion at any point in the preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of the formation of a silver halide grain precipitation to start spectral sensi- In order to prevent deterioration in photographic properties caused by formaldehyde gas, a compound described in U.S. Pat. No. 4,411,987 or 4,435,503, which can react with and fix formaldehyde, is preferably added to a light-sensitive material.

Various color couplers can be used in the present invention, and specific examples of these couplers are described in patents described in above-mentioned RD No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patent Nos.

1,425,020 and 1,476,760, U.S. Pat. Nos. 3,973,968, 4,314,023, and 4,511,649, and European Patent No. 249,473A.

Examples of a magenta coupler are preferably 5-pyrazolone and pyrazoloazole compounds, and more preferably, compounds described in, e.g., U.S. Pat. Nos. 4,310,619 and 4,351,897, European Patent No. 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and W088/04795.

Examples of a cyan coupler are phenol and naphthol couplers, preferably those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,211, 4,367,282, 4,409,320, and 4,576,910, British Patent No. 2,102,137, and European Patent No. 341,188A.

Preferred examples of a coupler capable of forming colored dyes having proper diffusibility are those described in U.S. Pat. No. 4,366,237, British Patent No. 2,125,570, European Patent No. 96,570, and West German Patent (Publication) No. 3,234,533.

Preferred examples of a colored coupler for correcting unnecessary absorption of a colored dye are those described in RD No. 17643, VII-G and No. 307105, VII-G, U.S. Pat. No. 4,163,670, JP-B-57-39413, U.S. Pat. Nos. 4,004,929 and 4,138,258, and British Patent No. 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 can be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Favored examples of a coupler for imagewise releasing a nucleating agent or a development accelerator are described in British Patent Nos. 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with the oxidation product of a developing agent.

Examples of other couplers which can be used in a light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in European Patent Nos. 173,302A and 313,308A; bleaching accelerator releasing couplers described in, e.g., RD. Nos. 11449 and 24241 and JP-A-61-201247; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

Couplers for use in the present invention can be added to a light-sensitive material by various known dispersion methods.

Examples of a high-boiling organic solvent to be used in an oil-in-water dispersion method are described in, e.g., U.S. Pat. No. 2,322,027.

Examples of a high-boiling organic solvent having a boiling point of 175° C. or more at atmospheric pressure to be used in the oil-in-water dispersion method are phthalic esters (e.g., dibutylphthalate, dicyclohexylphthalate, di-2-ethylhexylphthalate, decylphthalate, bis(2,4-di-tert-amylphenyl)phthalate, bis(2,4-di-tert-amylphenyl) isophthalate, and bis(1,1-diethylpropyl)phthalate); phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoates (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol); aliphatic carboxylates (e.g., bis(2-ethylhexyl)sebacate, dioctylazelate, glyceroltributylate, isostearyllactate, and trioctylcitrate); an aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

The steps and effects of a latex dispersion method and examples of an impregnating latex are described in, e.g., U.S. Pat. No. 4,199,363 and West German Patent Application (OLS) Nos. 2,541,274 and 2,541,230.

Phenethyl alcohol and various types of an antiseptic agent or a mildewproofing agent are preferably added to a color light-sensitive material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for general purposes or motion pictures, a color reversal film for slides or television, color paper, a color positive film, and color reversal paper. The present invention is also particularly preferably usable as a color dupe film.

A support which can be suitably used in the present invention is described in, e.g., RD. No. 17643, page 28, RD. No. 18716, from page 647, right column to page 648, left column, and RD. No. 307105, page 879.

In a light-sensitive material of the present invention, the sum total of film thicknesses of all hydrophilic colloidal layers on the side having emulsion layers is preferably 28

μm or less, more preferably, 23 μm or less, further preferably, 18 μm or less, and most preferably, 16 μm or less. A film swell speed $T_{1/2}$ is preferably 30 sec or less, and more preferably, 20 sec or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124–129. When 90% of a maximum swell film thickness reached by performing processing by using a color developing agent at 30° C. for 3 min and 15 sec is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In a light-sensitive material of the present invention, hydrophilic colloid layers (called back layers) having a total dried film thickness of 2 to 20 μm are preferably formed on the side of a support away from the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

A color photographic light-sensitive material according to the present invention can be developed by conventional methods described in RD. No. 17643, pp. 28–29, RD. No. 18716, p. 651, the left to right column, and RD No. 307105, pp. 880–881.

A color developer used in the development of a light-sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylan iline, 3-methyl-4-amino-N-ethyl-β-methoxyethylaniline, and sulfates, hydrochlorides, and p-toluenesulfonates thereof. Of these compounds, sulfate of 3-methyl-4-amino-N-ethyl-N-β-hydroxyethylaniline is most preferred. Two or more types of these compounds can be used jointly in accordance with the application.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer can also contain a preservative such as hydroxylamine, diethylhydroxylamine, a sulfite, hydrazines such as N,N-biscarboxymethylhydrazine, phenylsemicarbazides, triethanolamine, or catechol sulfonic acids; an organic solvent such as ethyleneglycol or diethyleneglycol; a development accelerator such as benzylalcohol, polyethyleneglycol, a quaternary ammonium salt, or amines; a dye forming coupler, a competing coupler, and an auxiliary developing agent such as 1-phenyl-3-pyrazolidone; a viscosity imparting agent; and various chelating agents represented by aminopolycarboxylic acid, aminopolyphosphonic acid, alkylphosphonic acid, and phosphonocarboxylic acid. Representative examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these acids.

In order to perform reversal development, black-and-white development is performed and then color development is performed.

As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in combination. The pH of the color and black-and-white developers is generally 9 to 12. Although the replenishment rate of these developers depends on a color photographic light-sensitive material to be processed, it is generally 3 liters (liters will be also referred to as "L" hereinafter) or less per $m^2$ of a light-sensitive material. The replenishment rate can be decreased to 500 milliliters (milliliters will be also referred to as "mL" hereinafter) or less by decreasing a bromide ion concentration in the replenisher. In order to decrease the replenishment rate, the area of contact of a processing solution with air is preferably decreased to prevent evaporation and air oxidation of the solution.

The area of contact of a photographic processing solution with air in a processing tank can be represented by an aperture rate defined below:

Aperture rate=[area ($cm^2$) of contact of processing solution with air]÷[volume ($cm^3$) of processing solution]

The above aperture rate is preferably 0.1 or less, and more preferably, 0.001 to 0.05. In order to reduce the aperture rate, a shielding member such as a floating cover can be placed on the liquid surface of the photographic processing solution in the processing tank. In addition, a method of using a movable cover described in JP-A-1-82033 or a slit developing method descried in JP-A-63-216050 can be used. The aperture is preferably reduced not only in color and black-and-white development steps but also in all subsequent steps, e.g., bleaching, bleach-fixing, fixing, washing, and stabilizing steps. In addition, the replenishment rate can be reduced by using a means of suppressing storage of bromide ions in the developing solution.

The color development time is normally two to five minutes. The processing time, however, can be shortened by setting high temperature and high pH and using the color developing agent at high concentration.

A photographic emulsion layer is generally subjected to bleaching after color development. Bleaching can be performed either simultaneously with fixing (bleach-fixing) or independently thereof. In addition, in order to increase the processing speed, bleach-fixing can be performed after bleaching. Also, the processing can be performed in a bleach-fixing bath having two continuous tanks, fixing can be performed before bleach-fixing, or bleaching can be performed after bleach-fixing, in accordance with the application. Examples of the bleaching agent are a compound of a multivalent metal such as iron(III), peroxides (in particular, soda persulfate is suited to color negative motion picture films), quinones, and a nitro compound. Typical examples of the bleaching agent are organic complex salts of iron(III), e.g., complex salts of aminopolycarboxylic acids such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, and complex salts of citric acid, tartaric acid, and malic acid. Of these compounds, iron(III) complex salts of aminopolycarboxylic acid such as iron(III) complex salts of ethylenediaminetetraacetic acid and 1,3-diaminopropanetetraacetic acid are preferred because they can increase the processing speed and prevent environmental contamination. The iron(III) complex salt of aminopolycarboxylic acid is particularly useful in both the bleaching and bleach-fixing solutions. The pH of the bleaching or bleach-fixing solution using the iron(III) complex salt of aminopolycarboxylic acid is normally 4.0 to 8. In order to increase the processing speed, however, the processing can be performed at lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-18426, and RD No. 17129 (July, 1978); a thiazolidine derivative described in JP-A-51-140129; thiourea derivatives described in JP-B-45-8506, JP-A-52-20832, JP-A-53-32735, and U.S. Pat. No. 3,706,561, and iodide salts described in West German Patent No. 1,127,715 and JP-A-58-16235; polyoxyethylene compounds descried in West German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, West German Patent No. 1,290,812, and JP-A-53-95630 are preferred. Compounds described in U.S. Pat. No. 4,552,884 are also preferred. These bleaching accelerators can be added to a light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent bleaching stains. The most preferable organic acid is a compound having an acid dissociation constant (pKa) of 2 to 5, e.g., acetic acid, propionic acid, or hydroxy acetic acid.

Examples of the fixing agent and the bleach-fixing agent are thiosulfate, thiocyanate, a thioether-based compound, thioureas, and a large amount of iodide salt. Of these compounds, the use of thiosulfate is common, and especially ammonium thiosulfate can be used in the widest range of applications. In addition, a combination of thiosulfate and, e.g., thiocyanate, a thioether-based compound, or thiourea is preferably used. As a preservative of the fixing solution or the bleach-fixing solution, sulfite, bisulfite, a carbonyl bisulfite adduct, or a sulfinic acid compound described in EP294,769A is preferred. Furthermore, in order to stabilize the fixing solution or the bleach-fixing solution, various types of aminopolycarboxylic acids or organic phosphonic acids are preferably added to the solution.

In the present invention, 0.1 to 10 mol/L of a compound having a pKa of 6.0 to 9.0 are preferably added to the fixing solution or the bleach-fixing solution in order to adjust the pH. It is preferable to add 0.1 to 10 mols/L of imidazoles such as imidazole, 1-methylimidazole, 1-ethylimidazole, and 2-methylimidazole.

The total time of a desilvering step is preferably as short as possible provided that no desilvering defect occurs. The time is preferably one to three minutes, and more preferably, one to two minutes. A processing temperature is 25° C. to 50° C., and preferably, 35° C. to 45° C. Within the preferable temperature range, the desilvering speed is increased, and the generation of stains after the processing can be effectively prevented.

In the desilvering step, stirring is preferably as strong as possible. Examples of a method of strengthening stirring are a method of colliding a jet stream of the processing solution against the emulsion surface of a light-sensitive material described in JP-A-62-183460, and a method of increasing the stirring effect using rotating means described in JP-A-62-183461. Other examples are a method of moving a light-sensitive material while the emulsion surface is brought into contact with a wiper blade placed in a solution to cause disturbance on the emulsion surface, thereby improving the stirring effect, and a method of increasing the circulating flow amount in an overall processing solution. Such a stirring improving means is effective in any of the bleaching solution, the bleach-fixing solution, and the fixing solution. Improving stirring presumably accelerates the supply of the bleaching agent and the fixing agent into an emulsion film to thereby increase the desilvering rate. The above stirring improving means is more effective when the bleaching accelerator is used, i.e., this means can significantly increase the accelerating effect or eliminate fixing interference caused by the bleaching accelerator.

An automatic processor for processing a light-sensitive material of the present invention preferably has a light-sensitive material conveyor means described in JP-A-60-191257, JP-A-60-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially the processing time of each processing step and reduces the replenishment rate of a processing solution.

A silver halide color photographic light-sensitive material of the present invention is normally subjected to a washing step and/or a stabilizing step after desilvering. The amount of water used in the washing step can be arbitrarily determined over a broad range in accordance with the properties (e.g., a property determined by a material used such as a coupler) of the light-sensitive material, the application of the material, the temperature of the water, the number of water tanks (the number of stages), a replenishing method such as a counter or forward current, and other diverse conditions. The relationship between the amount of water and the number of water tanks in a multi-stage counter-current method can be obtained by a method described in "Journal of the Society of Motion Picture and Television Engineering", Vol. 64, pp. 248–253 (May, 1955).

According to the above-described multi-stage counter-current method, the amount of water used for washing can be greatly decreased. Since washing water stays in the tanks for a long period of time, however, bacteria multiply and floating substances stick to a light-sensitive material. In order to solve this problem in the processing of a color light-sensitive material of the present invention, a method of decreasing calcium and magnesium ions described in JP-A-62-288838 can be very effectively used. It is also possible to use an isothiazolone compound, cyabendazoles, and a chlorine-based germicide such as chlorinated sodium isocyanurate described in JP-A-57-8542, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing a light-sensitive material of the present invention is 4 to 9, preferably 5 to 8. The water temperature and the washing time can vary in accordance with the properties and applications of a light-sensitive material. Normally, the washing time is 20 sec to 10 min at a temperature of 15° C. to 45° C., preferably 30 sec to 5 min at 25° C. to 40° C. A light-sensitive material of the present invention can be processed directly by a stabilizing agent in place of washing. All known methods described in JP-A-57-8543, JP-A-58-14834, and JP-A-60-220345 can be used in such a stabilizing process.

Stabilizing is sometimes performed subsequently to washing. An example is a stabilizing bath containing a dye stabilizing agent and a surface-active agent to be used as a final bath of a color light-sensitive material for photography. Examples of the dye stabilizing agent are aldehydes such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In processing using an automatic processor or the like, if each processing solution described above is condensed by evaporation, water is preferably added to correct the condensation.

A silver halide color photographic light-sensitive material of the present invention can contain a color developing agent in order to simplify the processing and increase the processing speed. For this purpose, various types of precursors of the color developing agent can be preferably used. Examples of the precursor are indoaniline-based compounds described in U.S. Pat. No. 3,342,597, e.g., Schiff base compounds described in U.S. Pat. No. 3,342,599 and RD Nos. 14,850 and 15,159, aldol compounds described in RD No. 13,924, metal salt complexes described in U.S. Pat. No. 3,719,492, and urethane-based compounds described in JP-A-53-135628.

A silver halide color light-sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at higher temperatures to shorten the processing time, or the image quality or the stability of a processing solution can be improved at lower temperatures.

A silver halide light-sensitive material of the present invention can be applied to thermal development light-sensitive materials described in, e.g., U.S. Pat. No. 4,500,626, JP-A-60-133449, JP-A-59-218443, JP-A-61-238056, and European Patent No. 210,660A2.

When a silver halide color photographic light-sensitive material of the present invention is applied to a film unit with lens, such as described in JP-B-2-32615 or Jpn. UM Appln. KOKOKU Publication No. 3-39784, the effects of the present invention can be achieved more easily.

Techniques such as a layer arrangement technique, silver halide emulsions, dye forming couplers, functional couplers such as DIR couplers, various additives, and development usable in emulsions of the present invention and light-sensitive materials using the emulsions are described in European Patent No. 0565096A1 (laid open in Oct. 13, 1993) and the patents cited in it. The individual items and the corresponding portions are enumerated below.

1. Layer arrangements: page 61, lines 23–35, page 61, line 41—page 62, line 14
2. Interlayers: page 61, lines 36–40
3. Interimage effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54-page 63, line 5
12. Physical ripening and chemical ripening of emulsions: page 63, lines 6–9
13. Use of emulsion mixtures: page 63, lines 10–13
14. Fogged emulsions: page 63, lines 14–31
15. Non-photosensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54-page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Photosensitive layer film thickness and swell speed: page 66, line 40-page 67, line 1
34. Back layers: page 67, lines 3–8
35. General development processing: page 67, lines 9–11
36. Developers and developing agents: page 67, lines 12–30
37. Developer additives: page 67, lines 31–44
38. Reversal processing: page 67, lines 45–56
39. Processing solution aperture ratio: page 67, line 57-page 68, line 12

40. Development time: page 68, lines 13–15
41. Bleach-fix, bleaching, and fixing: page 68, line 16-page 69, line 31
42. Automatic processor: page 69, lines 32–40
43. Washing, rinsing, and stabilization: page 69, line 41-page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

The present invention will be described in more detail below by way of its examples. However, the present invention is not limited to these examples.

EXAMPLE 1

Preparation of Emulsions (Preparation Method of Emulsion Em-1)

1,500 mL of an aqueous solution containing 19.5 g of KBr, 15.0 g of KI, 18.0 g of ammonium nitrate, and 30.0 g of gelatin were intensely stirred at 76° C. An aqueous solution containing 60.0 g of silver nitrate and an aqueous solution containing 23.0 g of KBr were added at constant rates over 8 min.

Next, 28 g of ammonia were added, and the resultant solution was held for 10 min. After the pH was adjusted to 6 by acetic acid, $1.5\times10^{-5}$ mol of thiourea dioxide and $1\times10^{-5}$ mol of an oxidizer (F-14) to be presented later were added. In addition, an aqueous solution containing 120.0 g of silver nitrate and an aqueous solution containing 82.5 g of KBr and 15.0 g of KI were added at constant rates over 30 min by the double-jet method.

After normal washing was performed, gelatin was added, and the pH and the pAg were adjusted to 5.8 and 8.8, respectively, at 40° C.

This emulsion consisted of tabular grains having an average equivalent-sphere diameter of 1.40 $\mu$m, an average equivalent-circle diameter of 1.77 $\mu$m, and an average aspect ratio of 3. Also, grains having an aspect ratio of 5 or more accounted for 10% of the projected area of all grains.

This emulsion was heated to 56° C. and optimally, chemically sensitized by adding sensitizing dyes ExS-1, ExS-2, and ExS-3, chloroauric acid, potassium thiocyanate, sodium thiosulfate, and compound (F-3) to be presented later. After the chemical sensitization, compound (F-3) was added.

ExS-1

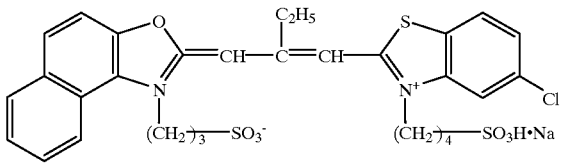

ExS-2

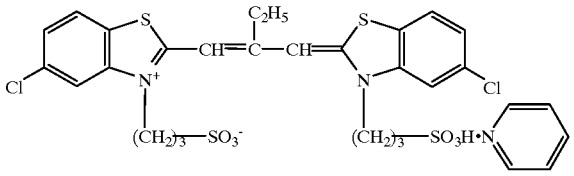

-continued

ExS-3

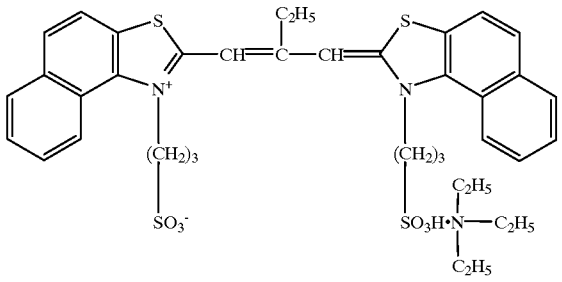

(Preparation Method of Emulsion Em-4)

1300 mL of an aqueous solution containing 1.6 g of low-molecular-weight oxidized gelatin having a weight-average molecular weight of 15,000 and 1.0 g of KBr were intensely stirred at 58° C. while the pH was adjusted to 9.

An aqueous solution containing 1.3 g of $AgNo_3$ and an aqueous solution containing 1.1 g of KBr and 0.7 g of low-molecular-weight oxidized gelatin having a weight-average molecular weight of 15,000 were added over 30 sec by the double-jet method, thereby performing nucleation. 6.6 g of KBr were added, and the solution was heated to 78° C. and ripened. After the ripening, 15.0 g of gelatin obtained by chemically modifying alkali-processed gelatin having a weight-average molecular weight of 100,000 with succinic anhydride were added, and the pH was adjusted to 5.5. 230 mL of an aqueous solution containing 29.3 g of $AgNO_3$ and an aqueous solution containing 15.8 g of KBr and 1.92 g of KI were added over 30 min by the double-jet method. During the addition, the silver potential was held at −20 mV with respect to a saturated calomel electrode. In addition, an aqueous solution containing 64.5 g of $AgNO_3$ and 233 mL of an aqueous solution containing 42.3 g of KBr and 5.14 g of KI were added over 37 min by the double-jet method, while the flow rates were accelerated such that the final flow rates were 1.33 times the initial flow rates. During the addition, the silver potential was held at −20 mV. Subsequently, an aqueous solution containing 70.8 g of $AgNO_3$ and an aqueous KBr solution were added over 35 min by the double-jet method with the silver potential held at −10 mV.

After the temperature was lowered to 40° C., 4.9 g of a compound 1 were added, and 32 mL of an aqueous 0.8 M sodium sulfite solution were added. Then, the pH was adjusted to 9.0 by using an aqueous NaOH solution and held for 5 min. After the temperature was raised to 55° C., the pH was adjusted to 5.5 by $H_2SO_4$. 1 mg of sodium benzenethiosulfonate was added, and 13 g of lime-processed gelatin having a calcium concentration of 1 ppm were added. After the addition, 250 mL of an aqueous solution containing 71.0 g of $AgNO_3$ and an aqueous KBr solution were added over 20 min with the silver potential held at +75 mV. During the addition, potassium ferrocyanide and $K_2IrCl_6$ were added in amounts of $1.0\times10^{-5}$ and $1\times10^{-8}$ mol, respectively, per mol of silver.

After washing, gelatin was added, and the pH and the pAg were adjusted to 6.5 and 8.8, respectively, at 40° C. The resultant emulsion was heated to 56° C. and optimally, chemically sensitized by adding compound 2 and sensitizing dyes ExS-5, ExS-6, ExS-7, ExS-8, and ExS-9, and then adding potassium thiocyanate, chloroauric acid, sodium thiosulfate, hexafluorophenyldiphenylphosphineselenide, compound (F-11) to be presented later, and compound 3. At the end of this chemical sensitization, compound (F-2) to be presented later was added.

This emulsion consisted of tabular grains having an average equivalent-sphere diameter of 1.33 μm, an average equivalent-circle diameter of 2.63 μm, and an average aspect ratio of 11.4. Also, grains having an aspect ratio of 5 or more accounted for 95% of the projected area of all grains.

The obtained grains were observed with a transmission electron microscope while being cooled by liquid nitrogen. As a consequence, in about 90% of all grains no dislocation lines existed within a portion which accounted for 80% of the projected area from the center of a grain. Also, 10 or more dislocation lines were observed per grain in a grain peripheral portion which accounted for 20% of the projected area from the edge of a grain.

Compound 1

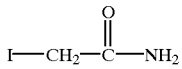

Compound 2

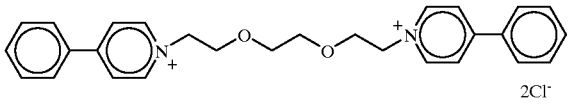

Compound 3

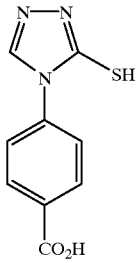

ExS-5

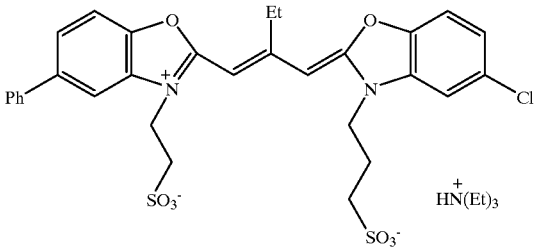

ExS-6

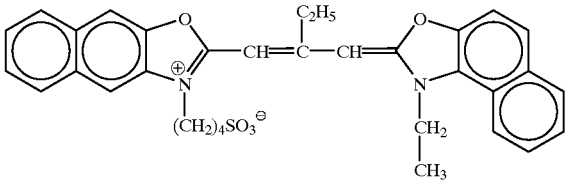

ExS-7

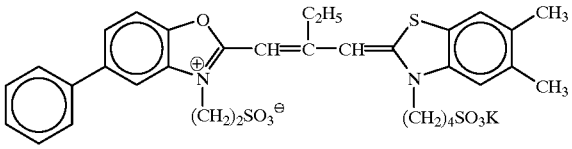

-continued

ExS-8

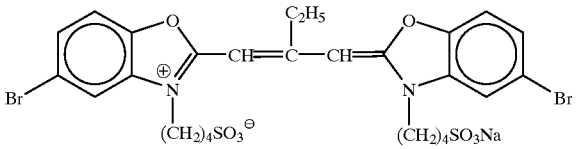

ExS-9

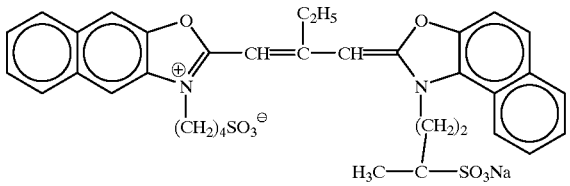

(Preparation Method of Emulsion Em-5)

1,200 mL of an aqueous solution containing 1.0 g of low-molecular-weight oxidized gelatin having a weight-average molecular weight of 15,000 and 0.9 g of KBr were intensely stirred at 35° C. 40 mL of an aqueous solution containing 1.85 g of $AgNO_3$ and 35 mL of an aqueous solution containing 1.82 g of KBr and 1.0 g of low-molecular-weight gelatin having a weight-average molecular weight of 15,000 were added over 30 sec by the double-jet method, thereby performing nucleation. Immediately after the addition, 5.4 g of KBr were added, and the resultant solution was heated to 75° C. and ripened. After the ripening, 35 g of gelatin obtained by chemically modifying alkali-processed gelatin having a weight-average molecular weight of 100,000 with succinic anhydride were added, and the pH was adjusted to 5.5. 250 mL of an aqueous solution containing 36 g of $AgNO_3$ and 282 mL of an aqueous solution containing 21.2 g of KBr and 2.81 g of KI were added over 25 min by the double-jet method with the silver potential held at −5 mV. After that, 650 mL of an aqueous solution containing 200 g of $AgNO_3$ and 900 mL of an aqueous solution containing 134.1 g of KBr and 13.9 g of KI were added over 100 min by the double-jet method, while the flow rates were accelerated such that the final flow rates were 1.4 times the initial flow rates. During the addition, the silver potential was held at +5 mV with respect to a saturated calomel electrode. After washing, gelatin was added, and the pH and the pAg were adjusted to 5.7 and 8.8, respectively. Also, the mass as an amount of silver per kg of an emulsion was adjusted to 139.0 g, and the gelatin mass was adjusted to 56 g, thereby preparing a seed emulsion.

1,200 mL of an aqueous solution containing 33 g of lime-processed gelatin having a calcium concentration of 1 ppm and 3.4 g of KBr were intensely stirred at 75° C. After 89 g of the seed emulsion described above were added, 0.3 g of modified silicone oil (L7602 manufactured by Nippon Uniker K.K.) was added. $H_2SO_4$ was added to adjust the pH to 5.8, and 2 mg of sodium benzenethiosulfonate and 2 mg of thiourea dioxide were added. After that, 600 mL of an aqueous solution containing 51.0 g of $AgNO_3$ and 600 mL of an aqueous solution containing 36.2 g of KBr and 3.49 g of KI were added over 85 min by the double-jet method, while the flow rates were accelerated such that the final flow rates were 1.1 times the initial flow rates. During the addition, the silver potential was held at −35 mV with respect to the saturated calomel electrode. In addition, 300 mL of an aqueous solution containing 44.7 g of $AgNO_3$ and 300 mL of an aqueous solution containing 30.6 g of KBr and 3.06 g of KI were added over 56 min by the double-jet method, while the flow rates were accelerated such that the final flow rates were 1.1 times the initial flow rates. During the addition, the silver potential was held at −35 mV with respect to the saturated calomel electrode. Subsequently, 180 mL of an aqueous solution containing 36.9 g of $AgNO_3$ and an aqueous KBr solution were added over 40 min by the double-jet method. During the addition, the silver potential was held at +10 mV with respect to the saturated calomel electrode. After KBr was added to adjust the silver potential to −70 mV, a fine-grain AgI emulsion having a grain size of 0.037 μm were added in an amount of 1.38 g as the mass of KI. Immediately after the addition, 100 mL of an aqueous solution containing 17.4 g of $AgNO_3$ were added over 15 min. After washing, gelatin was added, and the pH and the pAg were adjusted to 5.8 and 8.7, respectively. After being heated to 60° C., the emulsion was optimally, chemically sensitized by adding compound 2 and sensitizing dyes ExS-10 and ExS-13, and then adding potassium thiocyanate, chloroauric acid, sodium thiosulfate, hexafluorophenyldiphenylphosphineselenide, compound (F-11), and compound 3. At the end of this chemical sensitization, compound (F-3) to be presented later was added.

ExS-10

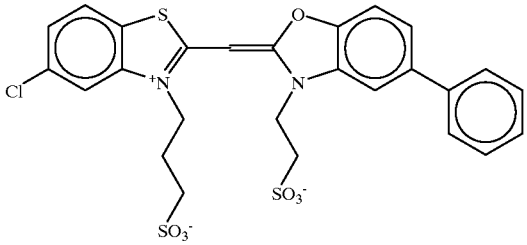

ExS-13

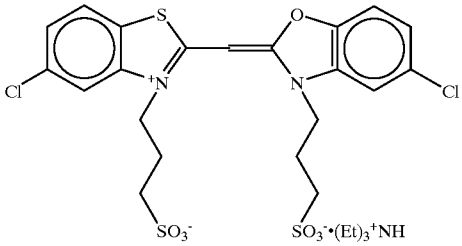

This emulsion consisted of tabular grains having an average equivalent-sphere diameter of 1.65 μm, an average equivalent-circle diameter of 3.10 μm, an equivalent-circle diameter variation coefficient of 20%, and an average aspect ratio of 10.0. Also, grains having an aspect ratio of 5 or more accounted for 90% of the projected area of all grains.

The obtained grains were observed with a transmission electron microscope while being cooled by liquid nitrogen. As a consequence, in about 98% of all grains no dislocation lines existed within a portion which accounted for 80% of the projected area from the center of a grain. Also, 10 or more dislocation lines were observed per grain in a grain peripheral portion which accounted for 20% of the projected area from the edge of a grain.

(Preparation Method of Emulsion Em-N)

1,250 mL of an aqueous solution containing 48 g of deionized gelatin and 0.75 g of KBr were intensely stirred at 70° C.

To this solution, 276 mL of an aqueous solution containing 12.0 g of $AgNO_3$ and an aqueous KBr solution of an equimolar concentration were added over 7 min by the double-jet method while the pAg was held at 7.26. 600 mL of an aqueous solution containing 108.0 g of $AgNO_3$ and an aqueous solution mixture (2.0 mol % of KI) of an equimolar concentration of KBr and KI were added over 18 min 30 sec by the double-jet method while the pAg was held at 7.30. 5 min before the end of the addition, 18.0 mL of an aqueous 0.1-mass % thiosulfonic acid solution were added. After the solution was redispersed by performing desalting and washing by the conventional flocculation method, the pH and the pAg were adjusted to 6.2 and 7.6, respectively, at 40° C. The temperature was then controlled to 40° C., the compound 2 and sensitizing dyes ExS-10 and ExS-12 were added, and potassium thiocyanate, chloroauric acid, sodium thiosulfate, hexafluorophenyldiphenylphosphineselenide, a compound (F-11), and the compound 3 were added. After that, the emulsion was heated to 68° C. and optimally, chemically sensitized. At the end of this chemical sensitization, compound (F-2) was added.

ExS-12

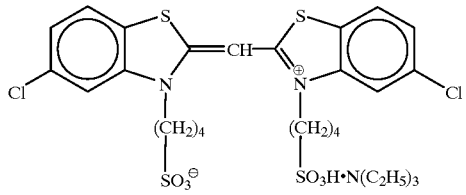

This emulsion consisted of cubic grains having an average equivalent-sphere diameter of 0.19 μm and an equivalent-sphere diameter variation coefficient of 14%.

Emulsions Em-A to Em-M and Em-2, Em-3, and Em-6 were prepared by appropriately changing the temperature, pH, silver potential, silver nitrate amount, KI amount, compound amount, sensitizing dye type, and seed emulsion amount in the preparation of the emulsions Em-1, Em-4, and Em-5 described above.

Tables 1 and 2 show the lists of the emulsions thus prepared.

TABLE 1

| Emulsion name | Average equivalent-circle diameter $D_c$ (μm) | Average grain thickness $T_h$ (μm) | Average aspect ratio $D_c/T_h$ | Average equivalent-sphere diameter (μm) | Average silver iodide content (mol %) | Surface silver iodide content (mol %) | Grain shape | Dislocation lines (lines/grain) | Ratio (%) accounted for by grains having an aspect ratio of 5 or more in all grains |
|---|---|---|---|---|---|---|---|---|---|
| Em-A | 1.50 | 0.35 | 4.3 | 1.10 | 3.7 | 2.0 | Tabular | 10 or more | 45 |
| Em-B | 1.50 | 0.15 | 10.0 | 0.80 | 5.0 | 3.0 | Tabular | 10 or more | 90 |

TABLE 1-continued

| Emulsion name | Average equivalent-circle diameter $D_c$ (μm) | Average grain thickness $T_h$ (μm) | Average aspect ratio $D_c/T_h$ | Average equivalent-sphere diameter (μm) | Average silver iodide content (mol %) | Surface silver iodide content (mol %) | Grain shape | Dislocation lines (lines/grain) | Ratio (%) accounted for by grains having an aspect ratio of 5 or more in all grains |
|---|---|---|---|---|---|---|---|---|---|
| Em-C | 0.85 | 0.12 | 7.1 | 0.51 | 4.7 | 4.0 | Tabular | 10 or more | 75 |
| Em-D | 0.40 | 0.15 | 2.7 | 0.35 | 3.9 | 3.0 | Tabular | 10 or more | 5 |
| Em-E | 1.50 | 0.35 | 4.3 | 1.10 | 3.7 | 2.0 | Tabular | 10 or more | 45 |
| Em-F | 2.00 | 0.14 | 14.3 | 0.92 | 5.0 | 3.2 | Tabular | 10 or more | 95 or more |
| Em-G | 1.60 | 0.13 | 12.3 | 0.79 | 5.5 | 3.5 | Tabular | 10 or more | 95 or more |
| Em-H | 0.85 | 0.12 | 7.1 | 0.51 | 4.7 | 4.0 | Tabular | 10 or more | 75 |
| Em-I | 0.58 | 0.18 | 3.2 | 0.45 | 3.7 | 3.5 | Tabular | 10 or more | 10 |
| Em-J | 2.00 | 0.14 | 14.3 | 0.92 | 5.0 | 3.2 | Tabular | 10 or more | 95 or more |
| Em-K | 1.50 | 0.50 | 3.0 | 1.20 | 14.0 | 5.6 | Thick twinned crystal | Unobservable | 10 |
| Em-L | 1.25 | 0.29 | 4.3 | 0.89 | 6.5 | 5.0 | Tabular | 10 or more | 45 |
| Em-M | 0.55 | 0.12 | 4.6 | 0.37 | 3.7 | 3.5 | Tabular | 10 or more | 50 |
| Em-N | — | — | — | 0.19 | 1.8 | 1.8 | Cubic | — | — |

TABLE 2

| Emulsion name | Average equivalent-circle diameter $D_c$ (μm) | Average grain thickness $T_h$ (μm) | Average aspect ratio $D_c/T_h$ | Average equivalent-sphere diameter (μm) | Average silver iodide content (mol %) | Surface silver iodide content (mol %) | Grain shape | Dislocation lines (lines/grain) | Ratio (%) accounted for by grains having an aspect ratio of 5 or more in all grains |
|---|---|---|---|---|---|---|---|---|---|
| Em-1 | 1.77 | 0.59 | 3.0 | 1.40 | 11.3 | 5.2 | Thick twinned crystal | Unobservable | 10 |
| Em-2 | 2.50 | 0.25 | 10.0 | 1.33 | 5.5 | 2.0 | Tabular | 10 or more | 90 |
| Em-3 | 2.02 | 0.45 | 4.5 | 1.40 | 10.3 | 5.0 | Thick twinned crystal | Unobservable | 50 |
| Em-4 | 2.63 | 0.23 | 11.4 | 1.33 | 5.0 | 2.2 | Tabular | 10 or more | 95 |
| Em-5 | 3.10 | 0.31 | 10.0 | 1.65 | 5.6 | 3.0 | Tabular | 10 or more | 90 |
| Em-6 | 2.60 | 0.27 | 9.8 | 1.40 | 5.5 | 3.5 | Tabular | 10 or more | 90 |

Formation of Coated Samples

An undercoated cellulose triacetate film support was coated with multiple layers having compositions presented below, thereby forming sample 101 as a multilayered color light-sensitive material.

(Compositions of Photosensitive Layers)

The main materials used in the individual layers are classified as follows.

ExC: Cyan coupler ExS: Spectral sensitizing dye

UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of silver halide is indicated by the amount of silver. The coating amount of spectral sensitizing dye is indicated in units of mols per mol of a silver halide in the same layer.

| | | |
|---|---|---|
| 1st layer (1st antihalation layer) | | |
| Black colloidal silver | silver | 0.070 |
| Gelatin | | 0.660 |
| ExM-1 | | 0.048 |
| Cpd-2 | | 0.001 |
| F-8 | | 0.001 |
| HBS-1 | | 0.090 |
| HBS-2 | | 0.010 |
| 2nd layer (2nd antihalation layer) | | |
| Black colloidal silver | silver | 0.090 |
| Gelatin | | 0.830 |
| ExM-1 | | 0.057 |
| ExF-1 | | 0.002 |
| F-8 | | 0.001 |
| HBS-1 | | 0.090 |
| HBS-2 | | 0.010 |
| 3rd layer (Interlayer) | | |
| ExC-2 | | 0.010 |
| Cpd-1 | | 0.086 |
| UV-2 | | 0.029 |
| UV-3 | | 0.052 |
| UV-4 | | 0.011 |
| HBS-1 | | 0.100 |
| Gelatin | | 0.580 |

-continued

| | | |
|---|---|---|
| 4th layer (Low-speed red-sensitive emulsion layer) | | |
| Em-D | silver | 0.57 |
| Em-C | silver | 0.47 |
| ExC-1 | | 0.222 |
| ExC-2 | | 0.010 |
| ExC-3 | | 0.072 |
| ExC-4 | | 0.148 |
| ExC-5 | | 0.005 |
| ExC-6 | | 0.008 |
| ExC-8 | | 0.071 |
| ExC-9 | | 0.010 |
| ExS-1 | | $1.4 \times 10^{-3}$ |
| ExS-2 | | $6.0 \times 10^{-4}$ |
| ExS-3 | | $2.0 \times 10^{-5}$ |
| UV-2 | | 0.036 |
| UV-3 | | 0.067 |
| UV-4 | | 0.014 |
| Cpd-2 | | 0.010 |
| Cpd-4 | | 0.012 |
| HBS-1 | | 0.240 |
| HBS-5 | | 0.010 |
| Gelatin | | 1.630 |
| 5th layer (Medium-speed red-sensitive emulsion layer) | | |
| Em-B | silver | 0.63 |
| ExC-1 | | 0.111 |
| ExC-2 | | 0.039 |
| ExC-3 | | 0.018 |
| ExC-4 | | 0.074 |
| ExC-5 | | 0.019 |
| ExC-6 | | 0.024 |
| ExC-8 | | 0.010 |
| ExC-9 | | 0.005 |
| ExS-1 | | $6.3 \times 10^{-4}$ |
| ExS-2 | | $2.6 \times 10^{-4}$ |
| ExS-3 | | $8.7 \times 10^{-6}$ |
| Cpd-2 | | 0.020 |
| Cpd-4 | | 0.021 |
| HBS-1 | | 0.129 |
| Gelatin | | 0.900 |
| 6th layer (High-speed red-sensitive emulsion layer) | | |
| Em-A | silver | 1.27 |
| ExC-1 | | 0.122 |
| ExC-6 | | 0.032 |
| ExC-8 | | 0.110 |
| ExC-9 | | 0.005 |
| ExC-10 | | 0.159 |
| ExS-1 | | $3.2 \times 10^{-4}$ |
| ExS-2 | | $2.6 \times 10^{-4}$ |
| ExS-3 | | $8.8 \times 10^{-6}$ |
| Cpd-2 | | 0.068 |
| Cpd-4 | | 0.015 |
| HBS-1 | | 0.440 |
| Gelatin | | 1.610 |
| 7th layer (Interlayer) | | |
| Cpd-1 | | 0.081 |
| Cpd-6 | | 0.002 |
| Solid disperse dye ExF-4 | | 0.015 |
| HBS-1 | | 0.049 |
| Polyethylacrylate latex | | 0.088 |
| Gelatin | | 0.759 |
| 8th layer (Layer for donating interimage effect to red-sensitive layer) | | |
| Em-J | silver | 0.40 |
| Cpd-4 | | 0.010 |
| ExM-2 | | 0.082 |
| ExM-3 | | 0.006 |
| ExM-4 | | 0.026 |
| ExY-1 | | 0.010 |
| ExY-4 | | 0.040 |
| ExC-7 | | 0.007 |
| ExS-4 | | $7.0 \times 10^{-4}$ |
| ExS-5 | | $2.5 \times 10^{-4}$ |
| HBS-1 | | 0.203 |
| HBS-3 | | 0.003 |

-continued

| | | |
|---|---|---|
| HBS-5 | | 0.010 |
| Gelatin | | 0.570 |
| 9th layer (Low-speed green-sensitive emulsion layer) | | |
| Em-H | silver | 0.23 |
| Em-C | silver | 0.15 |
| Em-I | silver | 0.26 |
| ExM-2 | | 0.388 |
| ExM-3 | | 0.040 |
| ExY-1 | | 0.003 |
| ExY-3 | | 0.002 |
| ExC-7 | | 0.009 |
| ExS-5 | | $3.0 \times 10^{-4}$ |
| ExS-6 | | $8.4 \times 10^{-5}$ |
| ExS-7 | | $1.1 \times 10^{-4}$ |
| ExS-8 | | $4.5 \times 10^{-4}$ |
| ExS-9 | | $1.3 \times 10^{-4}$ |
| HBS-1 | | 0.337 |
| HBS-3 | | 0.018 |
| HBS-4 | | 0.260 |
| HBS-5 | | 0.110 |
| Cpd-5 | | 0.010 |
| Gelatin | | 1.470 |
| 10th layer (Medium-speed green-sensitive emulsion layer) | | |
| Em-F | silver | 0.42 |
| ExM-2 | | 0.084 |
| ExM-3 | | 0.012 |
| ExM-4 | | 0.005 |
| ExY-3 | | 0.002 |
| ExC-6 | | 0.003 |
| ExC-7 | | 0.007 |
| ExC-8 | | 0.008 |
| ExS-7 | | $1.0 \times 10^{-4}$ |
| ExS-8 | | $7.1 \times 10^{-4}$ |
| ExS-9 | | $2.0 \times 10^{-4}$ |
| HBS-1 | | 0.096 |
| HBS-3 | | 0.002 |
| HBS-5 | | 0.002 |
| Cpd-5 | | 0.004 |
| Gelatin | | 0.382 |
| 11th layer (High-speed green-sensitive emulsion layer) | | |
| Em-E | silver | 0.95 |
| ExC-6 | | 0.002 |
| ExC-8 | | 0.010 |
| ExM-1 | | 0.014 |
| ExM-2 | | 0.023 |
| ExM-3 | | 0.023 |
| ExM-4 | | 0.005 |
| ExM-5 | | 0.040 |
| ExY-3 | | 0.003 |
| ExS-7 | | $8.4 \times 10^{-4}$ |
| ExS-8 | | $5.9 \times 10^{-4}$ |
| ExS-9 | | $1.7 \times 10^{-4}$ |
| Cpd-3 | | 0.004 |
| Cpd-4 | | 0.007 |
| Cpd-5 | | 0.010 |
| HBS-1 | | 0.259 |
| HBS-5 | | 0.020 |
| Polyethylacrylate latex | | 0.099 |
| Gelatin | | 0.781 |
| 12th layer (Yellow filter layer) | | |
| Cpd-1 | | 0.088 |
| Solid disperse dye ExF-2 | | 0.051 |
| Solid disperse dye ExF-8 | | 0.010 |
| HBS-1 | | 0.049 |
| Gelatin | | 0.593 |
| 13th layer (Low-speed blue-sensitive emulsion layer) | | |
| Em-N | silver | 0.12 |
| Em-M | silver | 0.09 |
| Em-L | silver | 0.50 |
| ExC-1 | | 0.024 |
| ExC-7 | | 0.011 |
| ExY-1 | | 0.002 |
| ExY-2 | | 0.956 |
| ExY-4 | | 0.091 |

-continued

| | | |
|---|---|---|
| ExS-10 | | $8.5 \times 10^{-5}$ |
| ExS-11 | | $6.4 \times 10^{-4}$ |
| ExS-12 | | $8.5 \times 10^{-5}$ |
| ExS-13 | | $5.0 \times 10^{-4}$ |
| Cpd-2 | | 0.037 |
| Cpd-3 | | 0.004 |
| HBS-1 | | 0.372 |
| HBS-5 | | 0.047 |
| Gelatin | | 2.201 |
| 14th layer (High-speed blue-sensitive emulsion layer) | | |
| Em-K | silver | 1.22 |
| ExY-2 | | 0.235 |
| ExY-4 | | 0.018 |
| ExS-10 | | $1.5 \times 10^{-4}$ |
| ExS-13 | | $2.0 \times 10^{-4}$ |
| Cpd-2 | | 0.075 |
| Cpd-3 | | 0.001 |
| HBS-1 | | 0.087 |
| Gelatin | | 1.156 |
| 15th layer (1st protective layer) | | |
| 0.07 μm silver iodobromide silver emulsion | | 0.28 |
| UV-1 | | 0.358 |
| UV-2 | | 0.179 |
| UV-3 | | 0.254 |
| UV-4 | | 0.025 |
| F-11 | | 0.0081 |
| S-1 | | 0.078 |
| ExF-5 | | 0.0024 |
| ExF-6 | | 0.0012 |
| ExF-7 | | 0.0010 |
| HBS-1 | | 0.175 |
| HBS-4 | | 0.050 |
| Gelatin | | 2.231 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.711 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6-mass % of water) of ExF-2 | 2.800 kg |
| Sodium octylphenyldiethoxymethane sulfonate (31-mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill LMK-4 until the absorbance ratio of the dispersion was 0.29, thereby obtaining a solid fine-grain dispersion. The average grain size of the fine dye grains was 0.29 μm.

Following the same procedure as above, solid dispersions of ExF-4 and ExF-8 were obtained. The average grain sizes of the fine dye grains were 0.28 and 0.49 μm, respectively.

Compounds used in the formation of each layer were as follows.

ExS-4

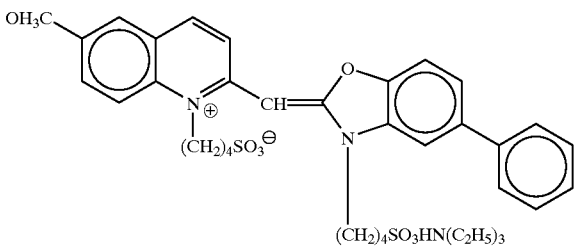

ExS-11

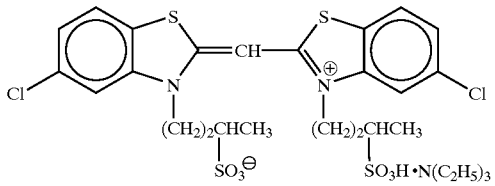

ExC-1

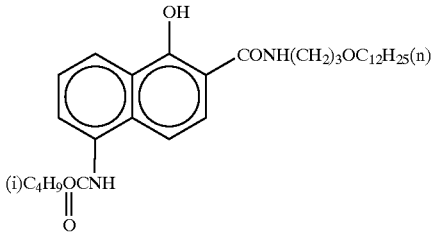

ExC-2

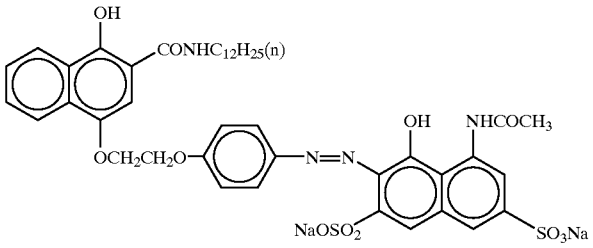

-continued
ExC-3
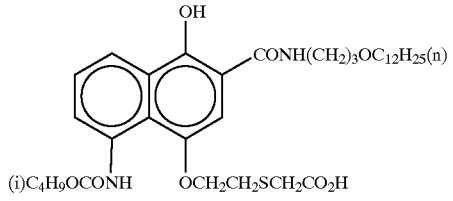
ExC-4
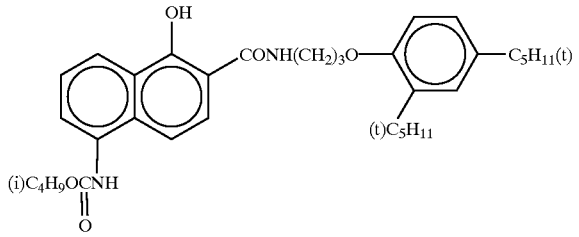
ExC-5
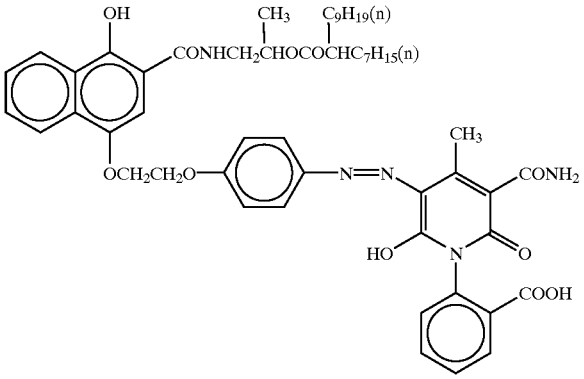
ExC-6
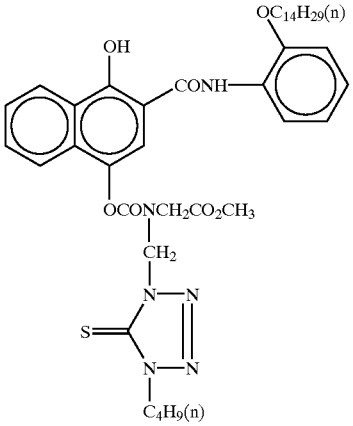
ExM-1
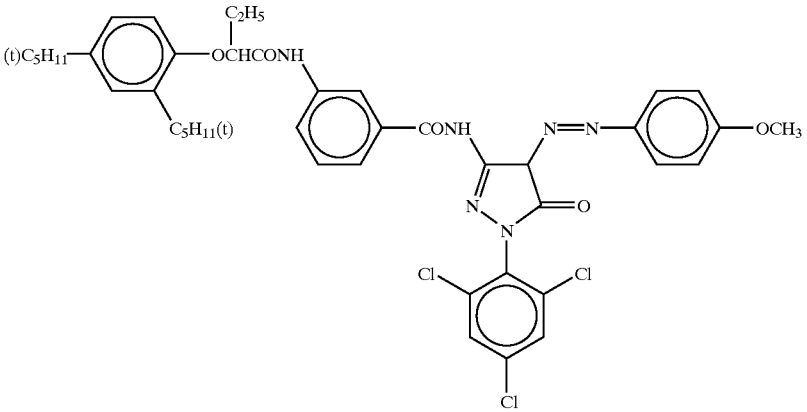
ExM-2
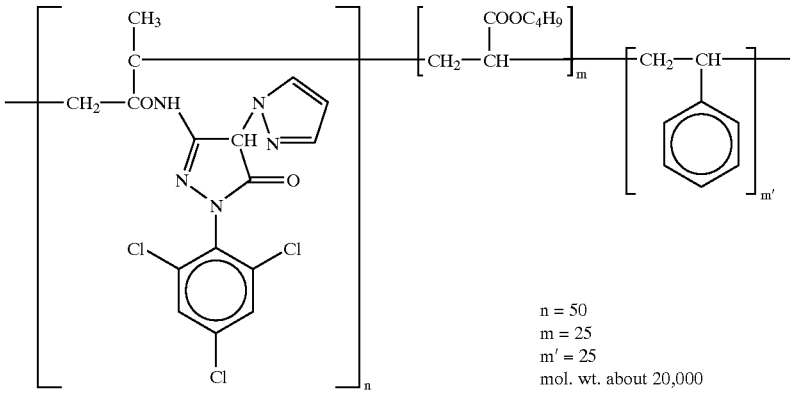
n = 50
m = 25
m′ = 25
mol. wt. about 20,000

-continued
ExM-3
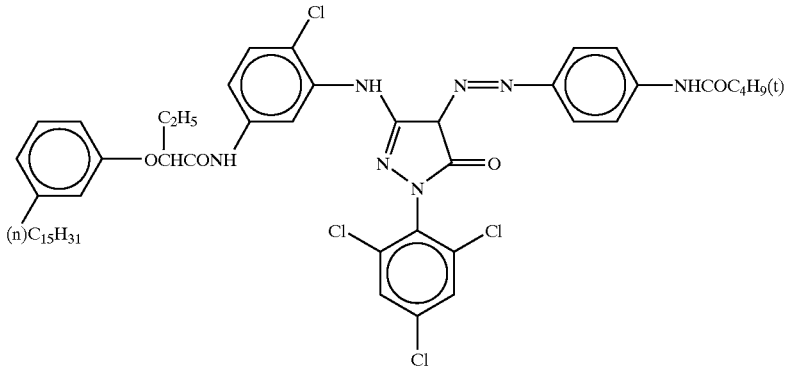
ExM-4
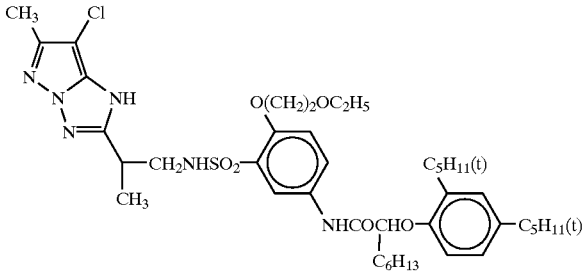
ExM-5
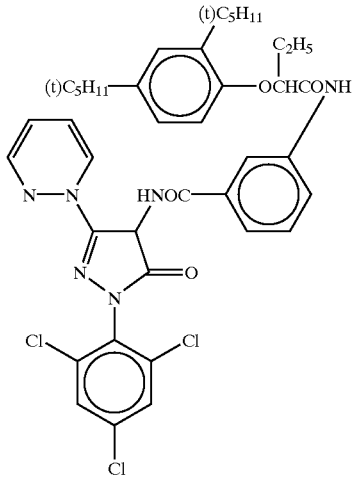
ExY-1
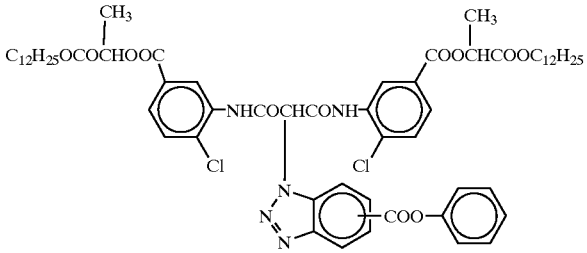
ExY-2
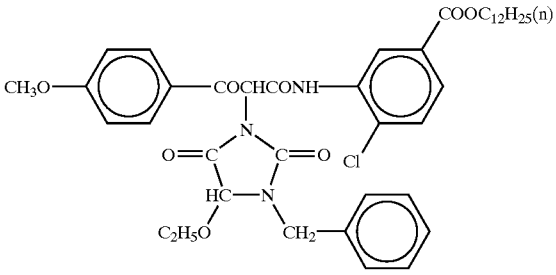
ExY-3
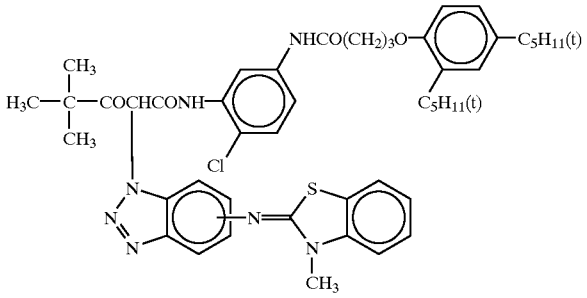
ExY-4
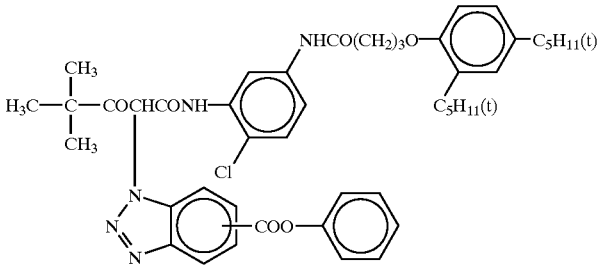

-continued
Cpd-1
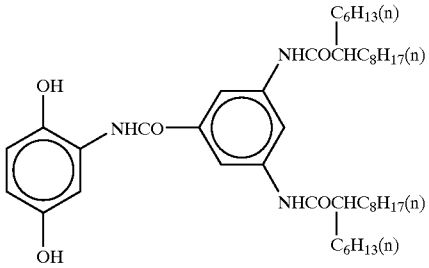
Cpd-2
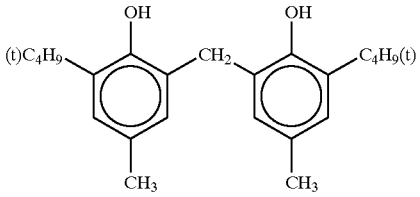
Cpd-3
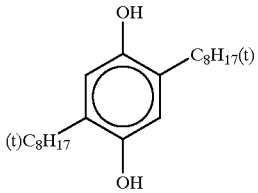
Cpd-4
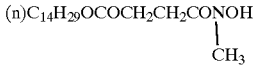
Cpd-5
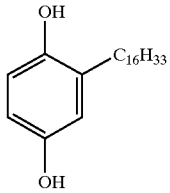
Cpd-6
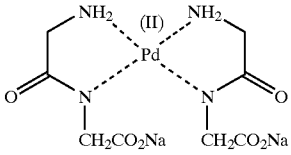
UV-1
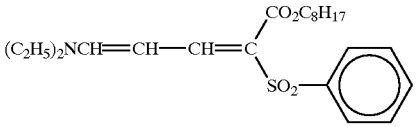
UV-2
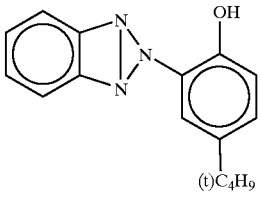
UV-3
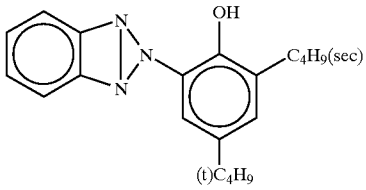
UV-4
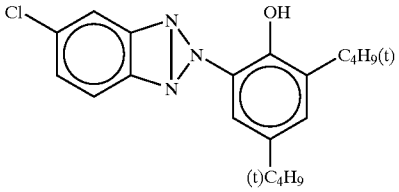
B-1
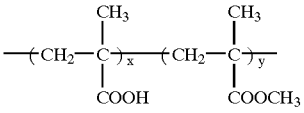
x/y = 10/90 (mass ratio)
average molecular weight:
about 35,000
B-2
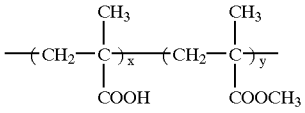
x/y = 40/60 (mass ratio)
average molecular weight:
about 20,000
B-3
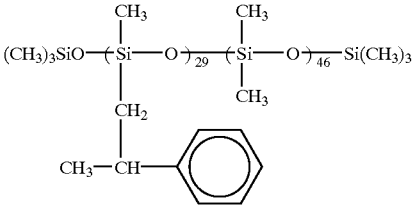
(mole ratio)
average molecular weight:
about 8,000
H-1
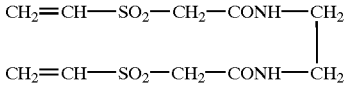

-continued
HBS-1
tricresyl phosphate
HBS-2
di-n-butyl phthalate
HBS-3
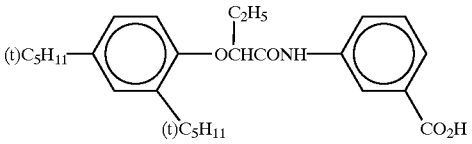
HBS-4
tri(2-ethylhexyl)phosphate
HBS-5
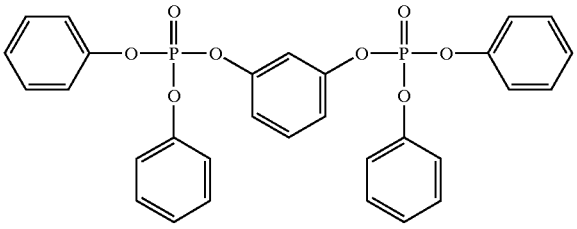
S-1
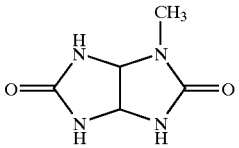
F-1
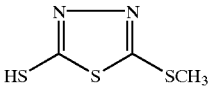
F-2
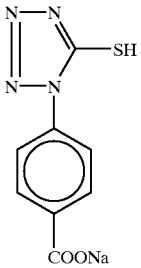
F-3
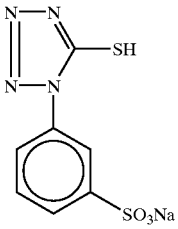
F-4
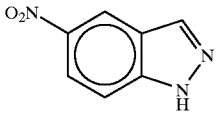
F-5
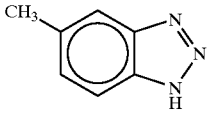
F-6
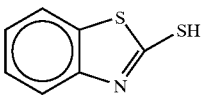
F-7
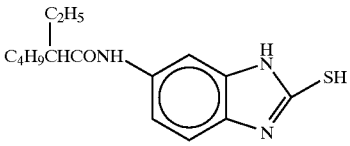
F-8
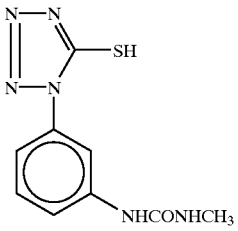
F-9
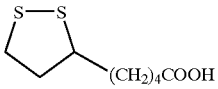
F-10
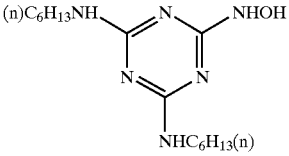

-continued
F-11
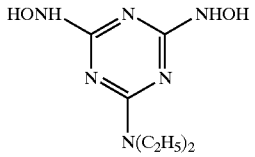
F-12
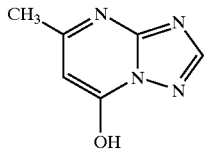
F-13
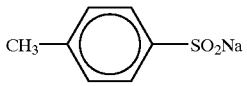
F-14
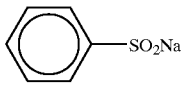
F-15
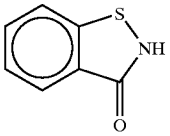
F-16
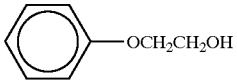
F-17
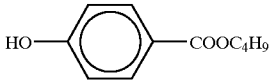
W-1
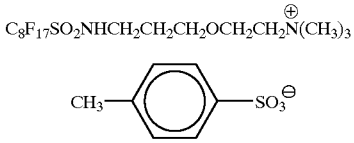
W-2
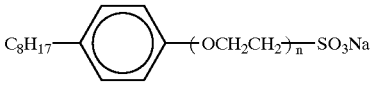
n = 2–4
W-3
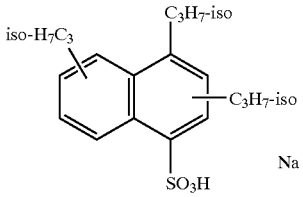
W-4
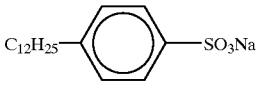
W-5
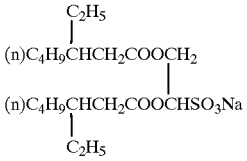
W-6
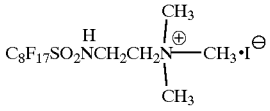
B-4
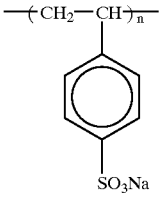
average molecular weight:
about 750,000
B-5
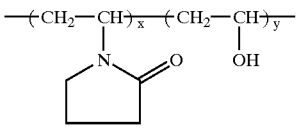
x/y = 70/30 (mass ratio)
average molecular weight:
about 17,000
B-6
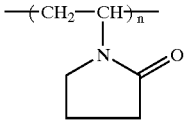
average molecular weight:
about 10,000

-continued
ExC-7
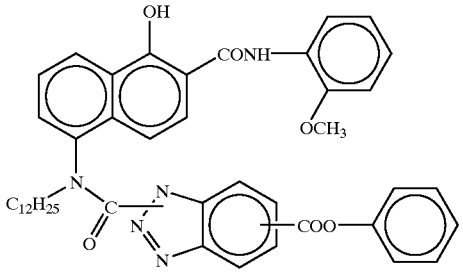
ExC-8
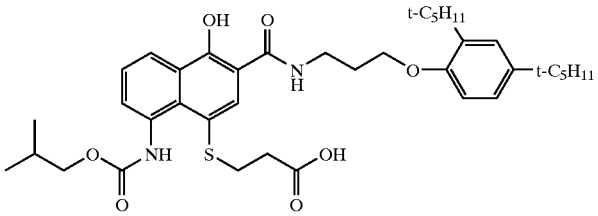
ExC-9
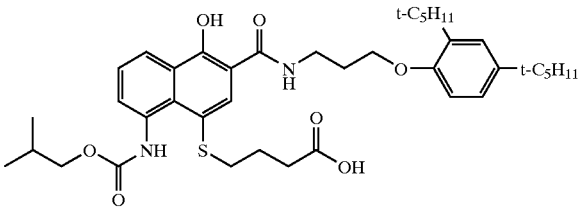
ExC-10
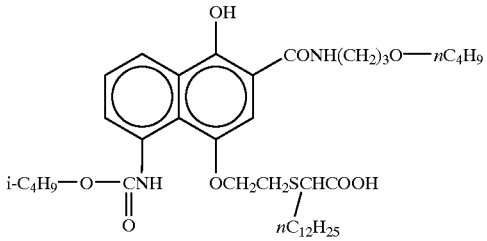
ExF-1
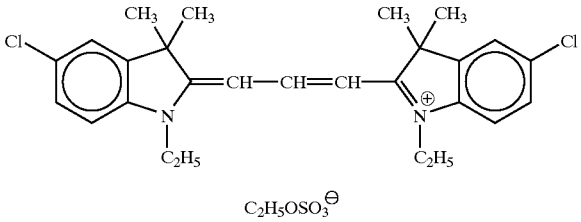
ExF-2
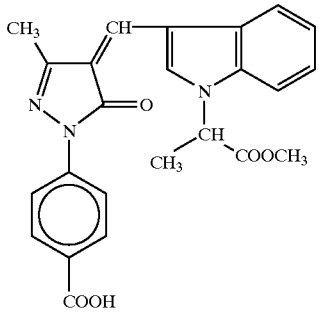
ExF-4
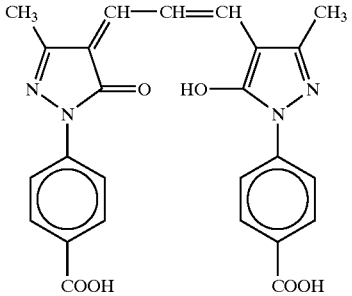
ExF-5
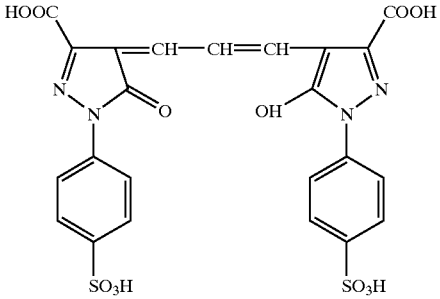
ExF-6
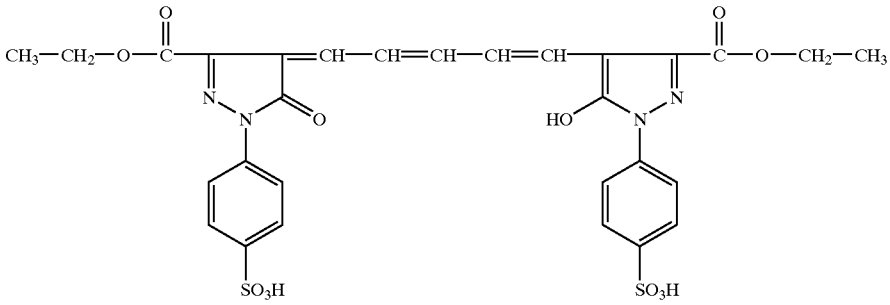

-continued

ExF-7

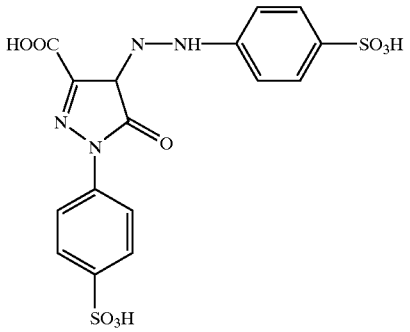

ExF-8

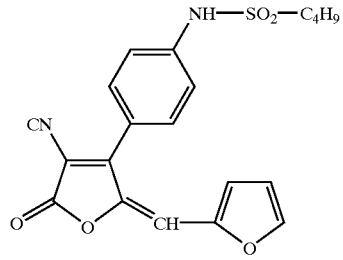

Samples 002 to 006 were formed by changing, as shown in Table 3 and Table 4, the silver halide emulsions in the 6th layer (high-speed red-sensitive emulsion layer), the 11th layer (high-speed green-sensitive emulsion layer), and the 14th layer (high-speed blue-sensitive emulsion layer) of sample 001 manufactured as above.

TABLE 3

| Sample No. | | Emulsions used | Silver coating amount $A_H$ ($g/m^2$) | Grain number = $AH/(D_c^2 \times T_h)$ | Total silver coating amount ($g/m^2$) in light-sensitive material | Remarks |
|---|---|---|---|---|---|---|
| 001 | 6th layer | Em-A | 1.27 | 1.61 | 7.72 | Comparative |
| | 11th layer | Em-E | 0.95 | 1.21 | | example |
| | 14th layer | Em-K | 1.22 | 1.08 | | |
| 002 | 6th layer | Em-A | 0.70 | 0.89 | 6.68 | Comparative |
| | 11th layer | Em-E | 0.70 | 0.89 | | example |
| | 14th layer | Em-K | 1.00 | 0.89 | | |
| 003 | 6th layer | Em-1 | 2.00 | 1.08 | 9.50 | Comparative |
| | 11th layer | Em-3 | 2.00 | 1.09 | | example |
| | 14th layer | Em-6 | 1.22 | 0.67 | | |

TABLE 4

| Sample No. | | Emulsions used | Silver coating amount $A_H$ ($g/m^2$) | Grain number = $AH/(D_c^2 \times T_h)$ | Total silver coating amount ($g/m^2$) in light-sensitive material | Remarks |
|---|---|---|---|---|---|---|
| 004 | 6th layer | Em-2 | 1.00 | 0.64 | 7.72 | Present |
| | | Em-B | 0.27 | 0.80 | | invention |
| | 11th layer | Em-4 | 0.70 | 0.44 | | |
| | | Em-F | 0.25 | 0.45 | | |
| | | Em-5 | 0.85 | 0.29 | | |
| | 14th layer | Em-6 | 0.37 | 0.20 | | |
| 005 | 6th layer | Em-2 | 2.00 | 1.28 | 10.22 | Comparative |
| | 11th layer | Em-4 | 2.00 | 1.28 | | example |
| | 14th layer | Em-5 | 2.00 | 0.67 | | |
| 006 | 6th layer | Em-2 | 1.27 | 0.81 | 7.72 | Present |
| | 11th layer | Em-4 | 0.95 | 0.60 | | invention |
| | 14th layer | Em-5 | 1.22 | 0.41 | | |

As described previously, a method of determining the specific photographic sensitivity according to the present invention is based on JIS K 7614-1981 except that development is completed within 30 min to 6 hr after sensitometry exposure, and that this development is done by FUJICOLOR processing formulation CN-16 described below.

Except the following development process, the method was the same as test conditions, exposure, density measurement, and specific photographic sensitivity determination described in JP-A-63-226650.

Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992 (issued by Japan Institute of Invention and Innovation).-

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis (2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixing (1) Tank Solution)

A 5:95 (volume ratio) mixture of the above bleaching tank solution and the following fixing tank solution.

(pH 6.8)

| (Fixing (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher (g) | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The relative sensitivity of each color-sensitive layer was calculated by the specific photographic sensitivity measurement method described above.

Fog was defined by minimum values (DYmin, DMmin, and DCmin) of the yellow density, magenta density, and cyan density. The sensitivity of each color-sensitive layer was defined by the logarithm of the reciprocal of an exposure amount by which density higher by 0.15 than each of DYmin, DMmin, and DCmin was given. The sensitivity of each sample was represented by a relative value with respect to 100, the reference value of sample 004.

The granularity was measured by the conventional RMS (Root Mean Square) method by performing the same processing as the measurement of the specific photographic sensitivity. This RMS measurement was done by performing exposure for 0.005 Lux·sec and by using an aperture 48 $\mu$m in diameter.

The sharpness was evaluated by measuring MTF. The measurement of MTF was performed by a method described in "Journal of Applied Photographic Engineering", Vol. 6(1)1–8 (1980).

The MTF value was evaluated by a spatial frequency of 25/mm and indicated by a relative value with respect to 100, the value of sample 004.

Table 5 shows the photographic properties of samples 001 to 006 thus calculated.

TABLE 5

| | Blue-sensitive layer | Green-sensitive layer | | Red-sensitive layer | | | |
|---|---|---|---|---|---|---|---|
| | Relative sensitivity | Relative sensitivity | MTF value | Relative sensitivity | MTF value | Specific sensitivity | Remarks |
| 001 | 51 | 62 | 85 | 63 | 83 | 820 | Comparative example |
| 002 | 30 | 33 | 105 | 33 | 102 | 420 | Comparative example |
| 003 | 70 | 105 | 52 | 95 | 45 | 1207 | Comparative example |
| 004 | 100 | 100 | 100 | 100 | 100 | 1270 | Present invention |
| 005 | 130 | 129 | 72 | 129 | 65 | 1690 | Comparative example |
| 006 | 124 | 123 | 96 | 123 | 92 | 1610 | Present invention |

In addition, each sample was cut, processed, and loaded into a packaging unit having a photographing function to obtain a photographic product containing a light-sensitive material.

(The lens F value and the shutter speed were fixed to 4 and 1/100 sec, respectively)

Under the conditions, photographing was performed outdoors in fine weather and indoors (in the place of a wedding reception in a wedding hall with no electronic flash). Development used to calculate the specific photographic sensitivity was performed, and the images were printed on color paper by using the conventional method. Tables 6 and 7 show the results of organoleptic evaluation of these images.

TABLE 6

| | Organoleptic evaluation | | Deterioration of performance by long-term aging | | | |
|---|---|---|---|---|---|---|
| Sample | Outdoors in fine weather | Indoors (no electronic flash) | | ΔFog *1) | RMS ratio *2) | Remarks |
| 001 | Satisfactory | Insufficient sensitivity, dark | Red-sensitive layer | 0.02 | 1.20 | Comparative example |
| | | | Green-sensitive layer | 0.02 | 1.18 | |
| | | | Blue-sensitive layer | 0.02 | 1.25 | |
| 002 | Satisfactory | Insufficient sensitivity, no pictures obtained | Red-sensitive layer | 0.01 | 1.15 | Comparative example |
| | | | Green-sensitive layer | 0.01 | 1.10 | |
| | | | Blue-sensitive layer | 0.01 | 1.15 | |
| 003 | Satisfactory | Slightly dark, low sharpness | Red-sensitive layer | 0.10 | 1.60 | Comparative example |
| | | | Green-sensitive layer | 0.10 | 1.55 | |

TABLE 6-continued

| | Organoleptic evaluation | | Deterioration of performance by long-term aging | | | |
|---|---|---|---|---|---|---|
| Sample | Outdoors in fine weather | Indoors (no electronic flash) | | ΔFog *1) | RMS ratio *2) | Remarks |
| | | | Blue-sensitive layer | 0.05 | 1.20 | |

*1) ΔFog = minimum density (25° C. 60%, 1 year) - minimum density (immediately after coating)
*2) RMS ratio = RMS value (25° C. 60%, 1 year) - RMS value (immediately after coating)

TABLE 7

| | Organoleptic evaluation | | Deterioration of performance by long-term aging | | | |
|---|---|---|---|---|---|---|
| Sample | Outdoors in fine weather | Indoors (no electronic flash) | | ΔFog *1) | RMS ratio *2) | Remarks |
| 004 | Satisfactory | Almost satisfactory | Red-sensitive layer | 0.01 | 1.25 | Present invention |
| | | | Green-sensitive layer | 0.01 | 1.22 | |
| | | | Blue-sensitive layer | 0.015 | 1.25 | |
| 005 | Satisfactory | Low sharpness, slightly unsatisfactory | Red-sensitive layer | 0.075 | 1.55 | Comparative example |
| | | | Green-sensitive layer | 0.08 | 1.60 | |
| | | | Blue-sensitive layer | 0.10 | 1.62 | |
| 006 | Satisfactory | Satisfactory | Red-sensitive layer | 0.02 | 1.32 | Present invention |
| | | | Green-sensitive layer | 0.02 | 1.30 | |

TABLE 7-continued

| Sample | Organoleptic evaluation: Outdoors in fine weather | Organoleptic evaluation: Indoors (no electronic flash) | Deterioration of performance by long-term aging | ΔFog *1) | RMS ratio *2) | Remarks |
|---|---|---|---|---|---|---|
| | | | Blue-sensitive layer | 0.01 | 1.30 | |

*1) ΔFog = minimum density (25° C. 60%, 1 year) - minimum density (immediately after coating)
*2) RMS ratio = RMS value (25° C. 60%, 1 year) - RMS value (immediately after coating)

Additionally, each sample was left to stand for one year in a room controlled at 25° C. 60% at all times, and the photographic sensitivity and the graininess were calculated by the same methods as above. These results are also shown in Table 6 and Table 7.

ΔFog represents a difference between the minimum density of each color-sensitive layer of a sample aged at 25° C. 60% for one year and that of a sample immediately after coating. The smaller the value, the smaller the deterioration of photographic properties. So, the value is preferably as small as possible.

RMS ratio represents the ratio of the RMS value of each color-sensitive layer of a sample aged at 25° C. 60% for one year to that of a sample immediately after coating. As the value becomes larger than 1, the photographic properties deteriorate more, so the result becomes more unfavorable.

As shown in this example, no problem arises when photographs are taken outdoors in fine weather. However, when photographs are to be taken in, e.g., the place of a wedding reception in a wedding hall where the use of an electronic flash is inhibited, the specific photographic sensitivity of a light-sensitive material desirably exceeds 1,000 as indicated by samples 004 and 006 of the present invention. When this is the case, if the grain number of a highest-speed layer of each color-sensitive layer exceeds 1.00 as in samples 003 and 005, the sharpness and storage stability (photographic property deterioration represented by long-term aging after coating) which are very important image quality properties cannot be met. Also, even by a sample in which the grain number of a highest-speed layer of each color-sensitive layer is 1.00 or less as indicated by sample 002, no satisfactory photographs can be taken by indoor photographing if the specific sensitivity is low.

EXAMPLE 2

The cellulose triacetate film support used in samples 001 to 006 formed in Example 1 was changed to the following support. When these samples were evaluated by the same methods as in Example 1, results similar to those in Example 1 were obtained.

The support used in this example was formed by the following method.

1) First Layer and Undercoat Layer

Glow discharge was performed on the two surfaces of a 90-μm thick polyethylenenaphthalate (PEN) support at a processing ambient pressure of 26.6 Pa, an $H_2O$ partial pressure in the ambient gas of 75%, a discharge frequency of 30 kHz, an output of 2,500 W, and a processing intensity of 0.5 kV·A·min/m$^2$. This support was coated with 5 mL/m$^2$ of a coating solution having the following composition as a first layer by using a bar coating method described in JP-B-58-4589.

| | |
|---|---|
| Conductive fine-grain dispersion (a water dispersion having an $SnO_2/Sb_2O_5$ grain concentration of 10%, a secondary aggregate having a primary grain size of 0.005 μm and an average grain size of 0.05 μm) | 50 parts by mass |
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly(polymerization degree 20) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Finally, the opposite side was coated with multiple layers of a color negative light-sensitive material having a composition to be described later, thereby making a transparent magnetic recording medium having silver halide emulsion layers.

2) Second Layer (Transparent Magnetic Recording Layer)

(i) Dispersion of Magnetic Substance 1,100 parts by mass of a Co-deposited γ-$Fe_2O_3$ magnetic substance (average long axis length: 0.25 μm, $S_{BET}$: 39 m$^2$/g, Hc: 6.56×10$^4$ A/m, σs: 77.1 Am$^2$/kg, σr: 37.4 Am$^2$/kg), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (¼ G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(ii) Formation of Magnetic Substance-Containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) SUMICORUNDUM AA-1.5 (average primary grain size 1.5 μm, specific surface area 1.3 $m^2/g$) Formation of grain dispersion

| | |
|---|---|
| SUMICORUNDUM AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(iii) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 $mL/m^2$ by using a wire bar. The solution was dried at 110° C. The thickness of the dried magnetic layer was 1.0 μm.

3) Third Layer (Higher Fatty Acid Ester Slipping Agent-Containing Layer)

(i) Formation of Undiluted Dispersion of Slipping Agent

Solution A presented below was dissolved at 100° C. and added to solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_5OH_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| Solution B | |
| Cyclohexanone | 8,600 parts by mass |

(ii) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 4: $(CH_3O)_3Si—(CH_2)_3—NH_2$) | 5.53 parts by mass |
| Compound 5 | 2.93 parts by mass |
| Compound 5 | |

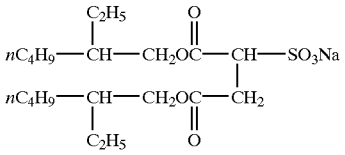

| | |
|---|---|
| SEAHOSTAR-KEP50 (amorphous spherical silica, average grain size 0.5 μm, manufactured by NIPPON SHOKUBAI Co., Ltd.) | 88.00 parts by mass |

The above formulation was stirred for 10 min, and the following was further added.

| | |
|---|---|
| Diacetone alcohol | 252.93 parts by mass |

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(iii) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 μm) | 60 parts by mass |

-continued

| | |
|---|---|
| Methylethylketone | 120 parts by mass |
| Cyclohexanone | 120 parts by mass |
| (solid content 20%, solvent: methylethylketone/cyclohexanone = 1/1) | |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(iv) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEAHOSTAR-KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The second layer was coated with 10.35 mL/m$^2$ of the above third layer coating solution, and the solution was dried at 110° C. and further dried at 97° C. for 3 min.

EXAMPLE 3

Samples were formed by coating a cellulose triacetate film support with the following back layer in samples 001 to 006 formed in Example 1.

That is, one surface of the support was coated with a back layer having the following composition.

| | |
|---|---|
| Methylmethacrylate-methacrylic acid copolymer (copolymerization molar ratio 1:1) | 1.5 parts by mass |
| Cellulose acetate hexahydrophthalate (4% hydroxypropyl group, 15% methyl group, 8% acetyl group, and 36% phthalyl group) | 1.5 parts by mass |
| Acetone | 50 parts by mass |
| Methanol | 25 parts by mass |
| Methylcellosolve | 25 parts by mass |
| Colloid carbon | 1.2 parts by mass |

The side of the support away from the side on which the back layer was formed was coated with multiple photosensitive layers following the same procedures as for samples 001 to 006 except that the first and second antihalation layers were not formed, thereby forming color negative films.

Evaluation was performed in the same manner as in Example 1 except that development was changed to the following steps. Consequently, results similar to those in Example 1 were obtained.

Development used in this example was as follows.

That is, development was performed as follows by using the KODAK ECN-2 (standard development for developing motion picture films) developer.

(ECN-2 processing)

| Step | Time | Temperature (° C.) |
|---|---|---|
| Prebath | 10 sec | 27 |
| Rem-jet removal · rinsing | 20 sec | 30 |
| Developer | 3 min | 41.1 |
| Stop bath | 30 sec | 30 |
| Washing | 30 sec | 30 |
| UL bleaching | 3 min | 27 |
| Washing | 1 min | 30 |
| Fixing | 2 min | 38 |
| Washing | 2 min | 30 |
| Rinsing | 10 sec | 30 |
| Drying | 5 to 7 min | 32–47 (relative humidity 30 to 50%) |

| | |
|---|---|
| <Composition of prebath> | |
| $H_2O$ | 800 mL |
| Borax (decahydrate) | 20 g |
| Sodium sulfate (anhydrate) | 100 g |
| Sodium hydroxide | 1 g |
| Water to make | 1 L |
| pH | 9.25 ± 0.10 |
| <Color developer composition> | |
| $H_2O$ | 850 mL |
| Kodak anti-calcium No. 4 | 2 mL |
| Sodium sulfite (anhydrate) | 2 g |
| Eastman anti-fog No. 9 | 0.22 g |
| Sodium bromide (anhydrate) | 1.2 g |
| Sodium carbonate (anhydrate) | 25.6 g |
| Sodium bicarbonate | 2.7 g |
| Kodak color developing agent CD-3 | 4 g |
| Water to make | 1 L |
| pH | 10.20 ± 0.5 |
| <Bleaching solution composition> | |
| $H_2O$ | 700 mL |
| Proxel GXL | 0.07 mL |
| Kodak chelating agent No. 1 | 24.2 g |
| 28% ammonium hydroxide solution | 30 mL |
| Ammonium bromide | 32.5 g |
| Glacial acetic acid | 10 mL |
| Ferric nitrate (enneahydrate) | 28.8 g |
| Water to make | 1 L |
| <Stop solution composition> | |
| $H_2O$ | 900 mL |
| 7.0 N sulfuric acid | 50 mL |
| Water to make | 1 L |
| <Fixing solution composition> | |
| $H_2O$ | 700 mL |
| Kodak anti-calcium No. 4 | 2 mL |
| 58% ammonium thiosulfate solution | 185 mL |
| Sodium sulfite (anhydrate) | 10 g |
| Sodium metabisulfite (anhydrate) | 8.4 g |
| Water to make | 1 L |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising, on a support, a unit blue-sensitive silver halide emulsion layer, unit green-sensitive silver halide emulsion layer, and unit red-sensitive silver halide emulsion layer, each of which includes not less than two color-sensitive layers differing in sensitivity, wherein tabular grains having an aspect ratio of not less than 5.0 account for not less than 60% of the total projected area of silver halide grains contained in an emulsion layer having the highest sensitivity in each unit color-sensitive layer, and a grain number indicated by equation (I) below is not more than 1.00:

$$(\text{Grain number})=A_H/(D_c^2\times T_h) \quad \text{(I)}$$

where $A_H$: a silver coating amount (g/m$^2$), as an amount of silver, of a silver halide contained in an emulsion layer having the highest sensitivity $D_c$: an average equivalent-circle diameter ($\mu$m) of silver halide grains contained in an emulsion layer having the highest sensitivity $T_h$: an average thickness ($\mu$m) of silver halide grains contained in an emulsion layer having the highest sensitivity, if silver halide grains contained in said emulsion layer are a mixture of not less than two types of silver halide emulsion grains having different average equivalent-circle diameters, the grain number is calculated from $A_H$, $D_c$, and $T_h$ of emulsion grains, of said not less than two types of emulsion grains, having the largest average equivalent-circle diameter.

2. The material according to claim 1, wherein said tabular grains have an aspect ratio of not less than 8.0.

3. The material according to claim 1, wherein said grain number indicated by equation (I) is not more than 0.8.

4. The material according to claim 1, wherein silver halide grains contained in an emulsion layer having the highest sensitivity in each unit color-sensitive layer are tabular grains which:

(a) have an average silver iodide content of 2 to 10 mol %, (b) have an average surface silver iodide content of 1 to 4 mol %, and (c) have not less than 10 dislocation lines per grain.

5. The material according to claim 1, wherein the total content of silver contained in said light-sensitive material is 3.0 to 8.5 g/m$^2$.

6. The material according to claim 5, wherein said tabular grains have an aspect ratio of not less than 8.0.

7. The material according to claim 5, wherein said grain number indicated by equation (I) is not more than 0.8.

8. The material according to claim 4, wherein the total content of silver contained in said light-sensitive material is 3.0 to 8.5 g/m$^2$.

9. The material according to claim 1, wherein the specific photographic sensitivity is not less than 1,000.

10. The material according to claim 4, wherein the specific photographic sensitivity is not less than 1,000.

11. The material according to claim 5, wherein the specific photographic sensitivity is not less than 1,000.

12. The material according to claim 8, wherein the specific photographic sensitivity is not less than 1,000.

13. The material according to claim 9, wherein said tabular grains have an aspect ratio of not less than 8.0.

14. The material according to claim 9, wherein said grain number indicated by equation (I) is not more than 0.8.

15. The material according to claim 9, wherein said specific photographic sensitivity is not less than 1,600.

16. The material according to claim 9, wherein said tabular grains have an aspect ratio of not less than 8.0 and said specific photographic sensitivity is not less than 1,600.

17. The material according to claim 9, wherein said grain number indicated by equation (I) is not more than 0.8 and said specific photographic sensitivity is not less than 1,600.

* * * * *

UNITED STATES PATENT AND TRADEMARK OFFICE

CERTIFICATE OF CORRECTION

PATENT NO. : 6,645,710 B2
DATED : November 11, 2003
INVENTOR(S) : Nishimura et al.

It is certified that error appears in the above-identified patent and that said Letters Patent is hereby corrected as shown below:

Title page,
Item [73], Assignee, should read as follows:
-- Fuji Photo Film Co., LTD., Kanagawa, Japan --
Item [74], *Attorney, Agent, or Firm* should read as follows:
-- [74] Birch, Stewart, Kolasch & Birch, LLP --

Signed and Sealed this

Fourteenth Day of December, 2004

JON W. DUDAS
*Director of the United States Patent and Trademark Office*